US011913129B2

(12) United States Patent
Kondoh et al.

(10) Patent No.: US 11,913,129 B2
(45) Date of Patent: Feb. 27, 2024

(54) FILM FORMATION METHOD FOR METALLIC COATING AND FILM FORMATION DEVICE FOR METALLIC COATING

(71) Applicant: TOYOTA JIDOSHA KABUSHIKI KAISHA, Toyota (JP)

(72) Inventors: Haruki Kondoh, Okazaki (JP); Akira Kato, Toyota (JP); Kazuaki Okamoto, Toyota (JP); Keiji Kuroda, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 231 days.

(21) Appl. No.: 17/484,045

(22) Filed: Sep. 24, 2021

(65) Prior Publication Data

US 2022/0098753 A1 Mar. 31, 2022

(30) Foreign Application Priority Data

Sep. 29, 2020 (JP) ..... 2020-162857

(51) Int. Cl.

| | |
|---|---|
| ***C25D 21/12*** | (2006.01) |
| ***C25D 5/06*** | (2006.01) |
| ***C25D 5/18*** | (2006.01) |
| ***C25D 17/00*** | (2006.01) |
| ***C25D 17/28*** | (2006.01) |

(52) U.S. Cl.

CPC ..... *C25D 21/12* (2013.01); *C25D 5/06* (2013.01); *C25D 17/005* (2013.01); *C25D 17/28* (2013.01); *C25D 5/18* (2013.01)

(58) Field of Classification Search

None

See application file for complete search history.

(56) References Cited

U.S. PATENT DOCUMENTS

2006/0163055 A1* 7/2006 Vereecken ..... C25D 21/12 257/E21.175

FOREIGN PATENT DOCUMENTS

| | | | | |
|---|---|---|---|---|
| JP | 6455454 B2 | | 1/2019 | |
| JP | 2019183241 A | * | 10/2019 | ..... F02P 5/1508 |
| JP | 2019183241 A | | 10/2019 | |

* cited by examiner

*Primary Examiner* — Louis J Rufo

(74) *Attorney, Agent, or Firm* — Dickinson Wright, PLLC

(57) ABSTRACT

It is determined whether an imaginary component at a predetermined frequency of an alternating current impedance is equal to or more than a preliminarily set film-formable value or not. The metallic coating is formed in a state where the substrate is pressed by the solid electrolyte membrane when the imaginary component is equal to or more than the film-formable value in the determining. The metallic coating is formed in a state where the pressing of the substrate by the solid electrolyte membrane is released to separate the solid electrolyte membrane from the substrate, the solid electrolyte membrane is re-tensioned with a constant tensile force, and subsequently, the substrate is pressed by the re-tensioned solid electrolyte membrane when the imaginary component is smaller than the film-formable value in the determining.

4 Claims, 10 Drawing Sheets

FILM FORMATION METHOD FOR METALLIC COATING AND FILM FORMATION DEVICE FOR METALLIC COATING

CROSS REFERENCE TO RELATED APPLICATIONS

The present application claims priority from Japanese patent application JP 2020-162857 filed on Sep. 29, 2020, the entire content of which is hereby incorporated by reference into this application.

BACKGROUND

Technical Field

The present disclosure relates to a film formation method and a film formation device for a metallic coating to form a metallic coating derived from metal ions on a surface of a substrate.

Background Art

As this type of film formation method for the metallic coating, for example, JP 2019-183241 A discloses a method for forming a metallic coating by disposing a solid electrolyte membrane impregnated with metal ions between an anode and a substrate, and applying a voltage between the anode and the substrate in a state of pressing the substrate by the solid electrolyte membrane.

In the method disclosed in JP 2019-183241 A, a contact state between the solid electrolyte membrane and the formed metallic coating is determined from an alternating current impedance to avoid integration of the solid electrolyte membrane and the metallic coating brought in contact therewith.

SUMMARY

However, in the method disclosed in JP 2019-183241 A, air is entrained between the solid electrolyte membrane and the substrate in some cases. In this case, since a portion in which the solid electrolyte membrane is not uniformly in contact with the substrate is present, the film formation in this state possibly causes spot and/or burnt deposit of the metallic coating.

The present disclosure has been made in consideration of such a problem and provides a film formation method and a film formation device for a metallic coating that allow avoiding an occurrence of the spot and the burnt deposit.

In consideration of such a problem, A film formation method for a metallic coating, wherein a metallic coating derived from metal ions is formed on a surface of a substrate by disposing a solid electrolyte membrane between an anode and the substrate that serves as a cathode, pressing the substrate by the solid electrolyte membrane with a fluid pressure of an electrolyte that is disposed between the anode and the solid electrolyte membrane and contains the metal ions, and applying a voltage between the anode and the substrate in a state of pressing the substrate, the method comprises: measuring an alternating current impedance between the anode and the substrate in a state where the solid electrolyte membrane is in contact with the substrate; determining whether an imaginary component at a predetermined frequency of the alternating current impedance is equal to or more than a preliminarily set film-formable value or not, the imaginary component at the predetermined frequency indicating a contact state between the solid electrolyte membrane and the substrate, and a film formation becoming performable at the film-formable value; forming the metallic coating in a state where the substrate is pressed by the solid electrolyte membrane when the imaginary component is equal to or more than the film-formable value in the determining; and forming the metallic coating in a state where the pressing of the substrate by the solid electrolyte membrane is released to separate the solid electrolyte membrane from the substrate, the solid electrolyte membrane is re-tensioned with a constant tensile force, and subsequently, the substrate is pressed by the re-tensioned solid electrolyte membrane when the imaginary component is smaller than the film-formable value in the determining.

According to the film formation method for the metallic coating of the present disclosure, since a capacitance increases when air is entrained between the solid electrolyte membrane and the substrate, the imaginary component of the alternating current impedance decreases. Therefore, by determining whether the imaginary component at the predetermined frequency is equal to or more than the film-formable value or not, it can be estimated before the film formation that the air is entrained between the solid electrolyte membrane and the substrate. Here, according to an experiment by the inventors, it was found that the air entrainment was often caused by an occurrence of a wrinkle of the solid electrolyte membrane due to the repetition of the film formation with the solid electrolyte membrane. Accordingly, in the present disclosure, the wrinkle of the solid electrolyte membrane is removed by the re-tensioning of the solid electrolyte membrane with the constant tensile force, and the air entrainment between the solid electrolyte membrane and the substrate is suppressed, thereby suppressing the occurrence of the spot and the burnt deposit of the metallic coating.

In an aspect, the film formation method for the metallic coating may further comprise: remeasuring the alternating current impedance after the re-tensioning of the solid electrolyte membrane, and redetermining whether the imaginary component of the remeasured alternating current impedance is equal to or more than the film-formable value or not; forming the metallic coating in a state where the substrate is pressed by the re-tensioned solid electrolyte membrane when the imaginary component is equal to or more than the film-formable value in the redetermining; and forming the metallic coating in a state where poles of the anode and the substrate that serves as the cathode are inverted in the state where the substrate is pressed by the re-tensioned solid electrolyte membrane, subsequently, the surface of the substrate is etched by applying a voltage between the anode and the substrate until the imaginary component reaches the film-formable value, and the etched substrate is pressed by the re-tensioned solid electrolyte membrane when the imaginary component is smaller than the film-formable value in the redetermining.

According to this aspect, since the capacitance increases also when an oxide is formed on the surface of the substrate, the imaginary component of the alternating current impedance decreases. Therefore, by determining whether the imaginary component at the predetermined frequency is equal to or more than the film-formable value or not, it can be estimated before the film formation that the oxide is formed on the surface of the substrate. When it is determined that the film formation of the metallic coating is not allowed due to the oxide, the surface of the substrate is etched by inverting the poles of the anode and the substrate in the state where the substrate is pressed by the re-tensioned solid electrolyte membrane, and subsequently applying the voltage therebetween. Since this etching allows removing the oxide on the surface of the substrate, the film formation using this substrate allows suppressing the spot, the burnt deposit, and the like of the metallic coating caused by the oxide.

In this description, a film formation device for appropriately performing the above-described film formation method for the metallic coating is disclosed. The film formation device for the metallic coating of the present disclosure comprises an anode, a solid electrolyte membrane, a housing, an elevating device, a pressing mechanism, and a power supply unit. The solid electrolyte membrane is disposed between the anode and a substrate that serves as a cathode. The housing houses an electrolyte containing metal ions. The solid electrolyte membrane is mounted to the housing. The electrolyte is disposed between the anode and the solid electrolyte membrane. The elevating device moves up and down the housing in an interval from a position at which the solid electrolyte membrane is separated from the substrate to a position at which the solid electrolyte membrane contacts the substrate. The pressing mechanism pressurizes the electrolyte housed in the housing to press the substrate in contact with the solid electrolyte membrane by the solid electrolyte membrane. The power supply unit applies a voltage between the anode and the substrate. A metallic coating derived from the metal ions is formed on a surface of the substrate by applying the voltage between the anode and the substrate in the state where the substrate is pressed. The film formation device further includes an impedance measurement device, a re-tensioning mechanism, and a control device. The impedance measurement device measures an alternating current impedance between the anode and the substrate in a state where the solid electrolyte membrane is in contact with the substrate. The re-tensioning mechanism re-tensions the solid electrolyte membrane mounted to the housing with a constant tensile force. The control device controls at least the moving up and down by the elevating device, the pressing by the pressing mechanism, the applying the voltage by the power supply unit, executing the measurement by the impedance measurement device, and the re-tensioning by the re-tensioning mechanism. The control device includes a measurement execution unit, a film formation execution determination unit, a film formation execution unit, and a re-tensioning execution unit. The measurement execution unit causes the impedance measurement device to execute the measurement of the alternating current impedance in a state where the housing is moved down by the elevating device to the position at which the solid electrolyte membrane contacts the substrate to bring the solid electrolyte membrane into contact with the substrate. The film formation execution determination unit determines to permit the film formation of the metallic coating when an imaginary component at a predetermined frequency of the alternating current impedance measured by the measurement execution unit is equal to or more than a preliminarily set film-formable value at which the film formation becomes performable, and determines to inhibit the film formation of the metallic coating when the imaginary component is smaller than the film-formable value. The imaginary component at the predetermined frequency indicates a contact state between the solid electrolyte membrane and the substrate. The film formation execution unit forms the metallic coating by causing the pressing mechanism to press the substrate by the solid electrolyte membrane and causing the power supply unit to apply the voltage when the film formation execution determination unit has determined to permit the film formation. The re-tensioning execution unit causes the pressing mechanism to release the pressing of the substrate by the solid electrolyte membrane, causes the elevating device to move up the housing to the position at which the solid electrolyte membrane is separated from the substrate, and causes the re-tensioning mechanism to re-tension the solid electrolyte membrane with the constant tensile force when the film formation execution determination unit has determined to inhibit the film formation.

According to the film formation device of the present disclosure, the film formation execution determination unit determines to inhibit the film formation of the metallic coating when the imaginary component at the predetermined frequency of the alternating current impedance indicating the contact state between the solid electrolyte membrane and the substrate is smaller than the preliminarily set film-formable value at which the film formation becomes performable. Accordingly, it can be estimated before the film formation that the air is entrained between the solid electrolyte membrane and the substrate. Specifically, it is assumed that repeatedly performing the film formation with the solid electrolyte membrane causes the wrinkle of the solid electrolyte membrane, and the wrinkle causes the air entrainment between the solid electrolyte membrane and the substrate. Therefore, when the film formation execution determination unit determines to inhibit the film formation, the re-tensioning mechanism re-tensions the solid electrolyte membrane with the constant tensile force. Accordingly, the wrinkle of the solid electrolyte membrane as the cause of the air entrainment be removed. Consequently, the air entrainment between the solid electrolyte membrane and the substrate is suppressed, and the occurrence of the spot, the burnt deposit, and the like on the metallic coating is suppressed.

In an aspect, the control device may further include a remeasurement execution unit, a film formation redetermination unit, and an etching execution unit. The remeasurement execution unit causes the measurement execution unit to execute a remeasurement of the alternating current impedance by the impedance measurement device after the re-tensioning of the solid electrolyte membrane by the re-tensioning execution unit. The film formation redetermination unit determines to permit the film formation of the metallic coating when the imaginary component of the alternating current impedance remeasured by the remeasurement execution unit is equal to or more than the preliminarily set film-formable value at which the film formation becomes performable, and determines to inhibit the film formation of the metallic coating and permit an etching of the substrate when the imaginary component is smaller than the film-formable value. The etching execution unit etches the surface of the substrate by causing the pressing mechanism to press the substrate by the solid electrolyte membrane, and causing the power supply unit to invert poles of the anode and the substrate that serves as the cathode and apply a voltage until the imaginary component reaches the film-formable value when the film formation redetermination unit has determined to permit the etching. The film formation execution unit forms the metallic coating by causing the pressing mechanism to press the substrate by the solid electrolyte membrane and causing the power supply unit to apply the voltage when the film formation redetermination unit has determined to permit the film formation and when the etching execution unit has completed the etching.

According to this aspect, the film formation redetermination unit inhibits the film formation of the metallic coating when the imaginary component is smaller than the film-formable value. Therefore, it can be estimated before the film formation that the oxide is formed on the surface of the substrate. In addition, the film formation redetermination unit determines to permit the etching of the substrate as well as the inhibition of the film formation when the imaginary component is determined to be smaller than the film-formable value. Therefore, the surface of the substrate can be etched by the etching execution unit, thus allowing the removal of the oxide on the surface of the substrate. The film formation using this substrate allows suppressing the spot, the burnt deposit, and the like of the metallic coating caused by the oxide.

With the film formation method and the film formation device for the metallic coating of the present disclosure, the metallic coating can be formed while avoiding the occurrence of the spot and the burnt deposit.

DETAILED DESCRIPTION

The following describes first and second embodiments and a reference example according to the present disclosure by referring to FIG. 1A to FIG. 8.

First Embodiment

1. Structure of Film Formation Device 1

By referring to FIG. 1A to FIG. 1C and FIG. 2, a description will be given of a film formation device 1 that allows appropriately performing a film formation of a metallic coating according to the first embodiment. Dashed lines illustrated in FIG. 1A to FIG. 1C indicate signal lines of control signals output from a control device 50 and signal lines output from a re-tensioning mechanism 30 and an impedance measurement device 40.

The film formation device 1 of the embodiment is a film formation device (plating device) that performs a film formation of a metallic coating by a solid electrolyte deposition, and used in performing a film formation (formation) of a metallic coating F on a surface of a substrate W while having the substrate W as a cathode. The film formation device 1 is used when the metallic coating F is continuously formed on the surfaces of a plurality of the substrates W. The substrate W that serves as the cathode is formed of a metallic material having a conductive property, and can include copper, nickel, silver, gold, or the like.

Figure 1A:
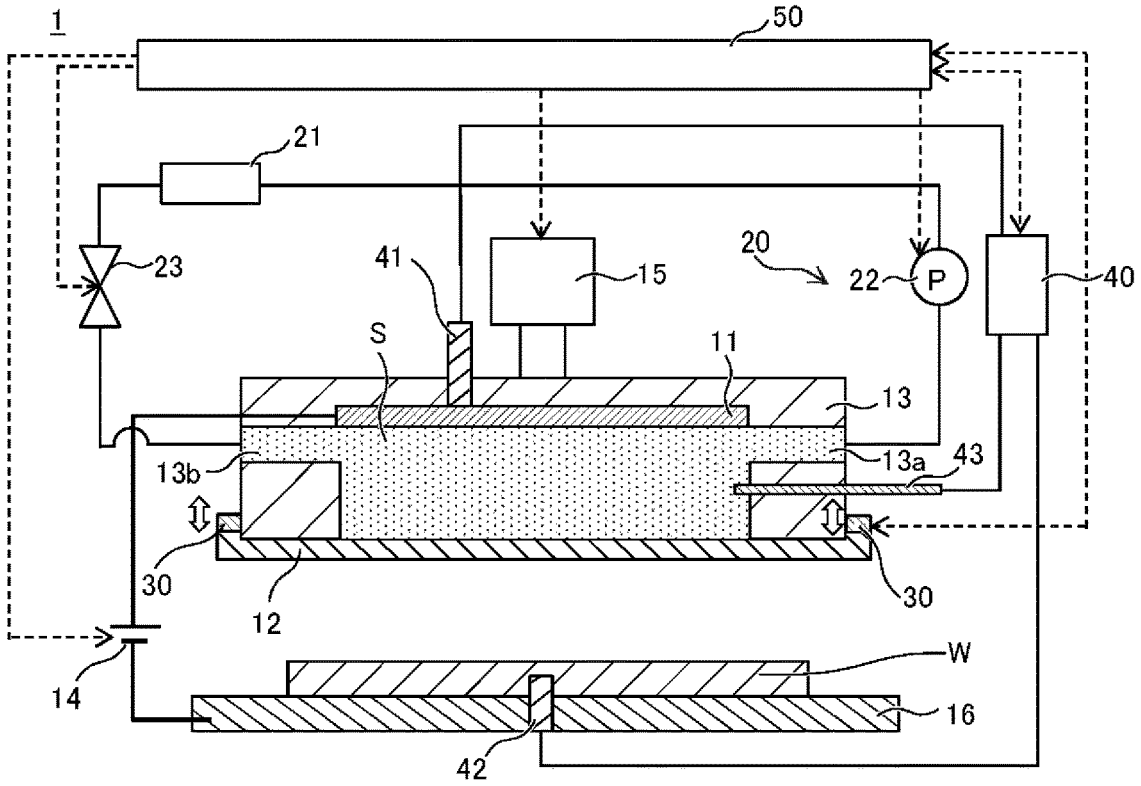
FIG. 1A is a schematic cross-sectional view for describing a state where a substrate is mounted to a film formation device for a metallic coating according to a first embodiment of the present disclosure.
Figure 1B:
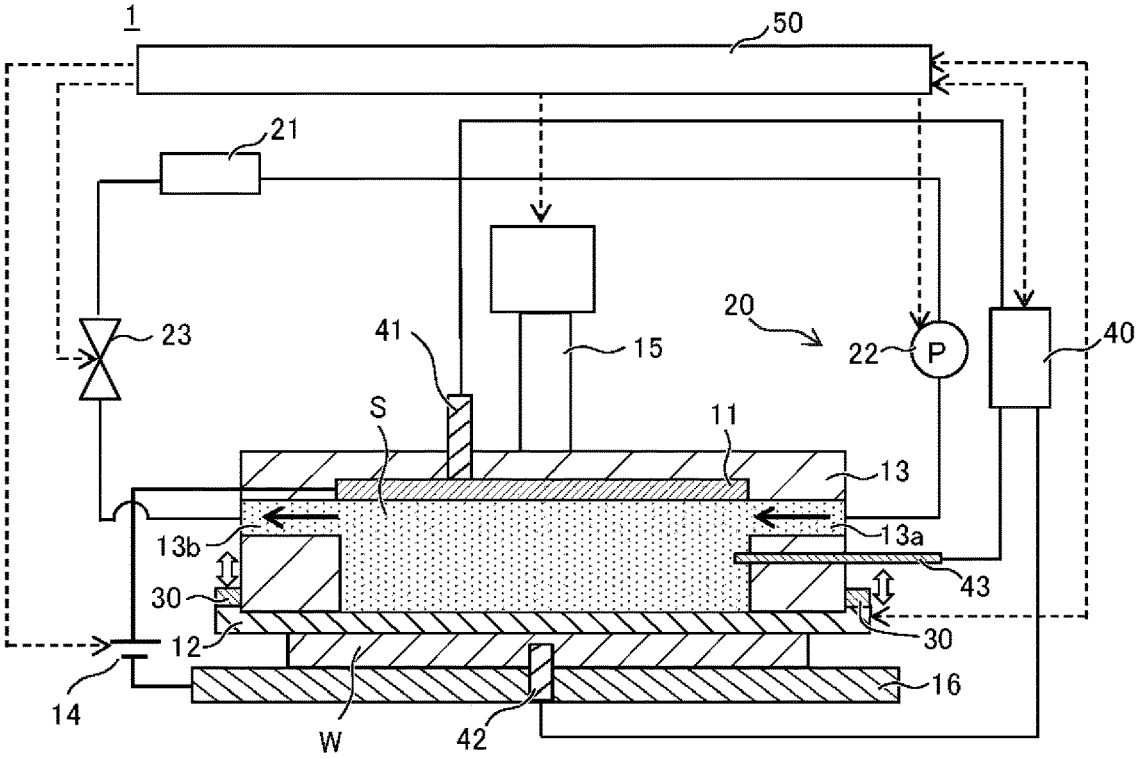
FIG. 1B is a schematic cross-sectional view for describing a measurement of an impedance using the film formation device illustrated in FIG. 1A.
Figure 1C:
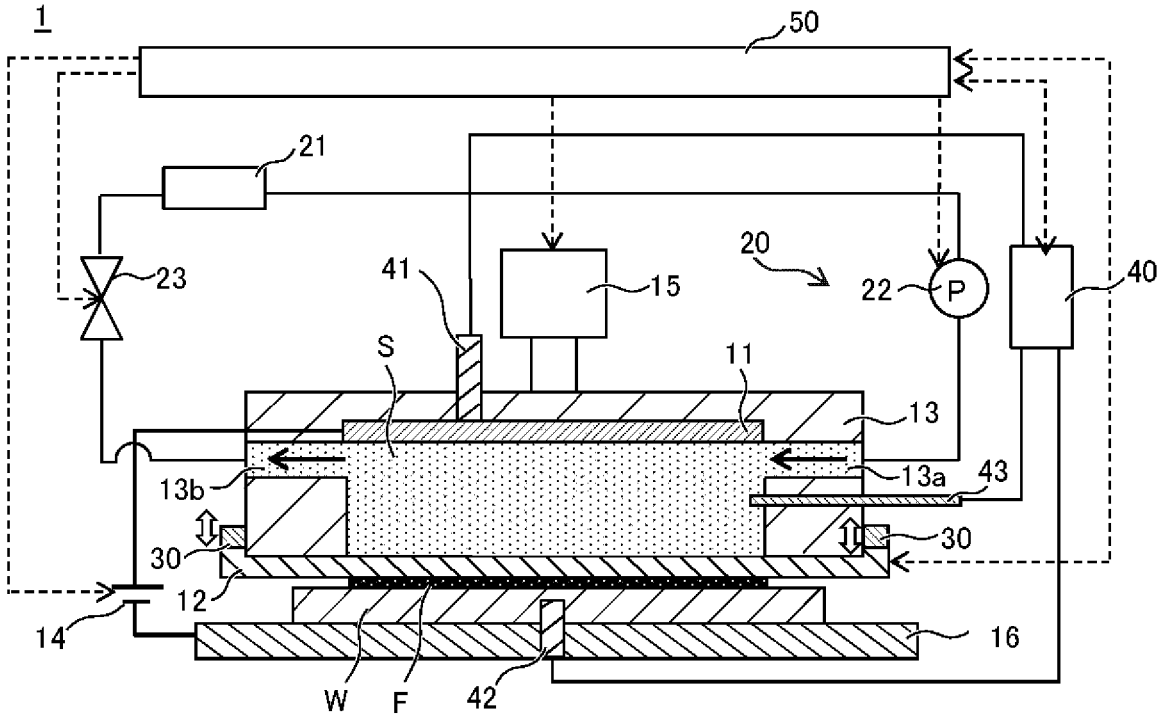
FIG. 1C is a schematic cross-sectional view for describing a film formation of a metallic coating using the film formation device illustrated in FIG. 1A.

As illustrated in FIG. 1A to FIG. 1C, the film formation device 1 includes a metallic anode 11, a solid electrolyte membrane 12 disposed between the anode 11 and the substrate W that serves as the cathode, and a power supply unit 14 that applies a voltage between the anode 11 and the substrate W. A constant voltage is applied between the anode 11 and the substrate W by the power supply unit 14 in a state where the solid electrolyte membrane 12 is brought in contact with the surface of the substrate W, thereby flowing a current between the anode 11 and the substrate W during the film formation.

In this embodiment, the film formation device 1 further includes a housing 13. The housing 13 houses the anode 11 and an electrolyte S containing ions of a metal (for example, Cu) that is a material of the metallic coating F, and the solid electrolyte membrane 12 is mounted to the housing 13. More specifically, a space for housing the electrolyte S is formed between the anode 11 and the solid electrolyte membrane 12, and the housed electrolyte S flows from one side to the other side.

The anode 11 and the solid electrolyte membrane 12 are separately disposed, and the anode 11 has a plate shape. The anode 11 may be any of a soluble anode formed of a material (for example, Cu) the same as that of the metallic coating F, or an anode formed of a material (for example, Ti) that is insoluble in the electrolyte S.

The solid electrolyte membrane 12 is not specifically limited insofar as the solid electrolyte membrane 12 can be internally impregnated with (contain) the metal ions by bringing the solid electrolyte membrane 12 into contact with the above-described electrolyte S, and a metal derived from the metal ions can be deposited on a surface of the cathode (substrate W) when the voltage is applied.

The solid electrolyte membrane 12 has a thickness of, for example, 5 μm to 200 μm. Examples of the material of the solid electrolyte membrane 12 can include a resin having a cation-exchange function, including fluorine-based resin, such as Nafion (registered trademark) manufactured by DuPont de Nemours, Inc., hydrocarbon resin, polyamic acid resin, and Selemion (CMV, CMD, CMF series) manufactured by AGC Inc.

The electrolyte S is a liquid containing the metal of the metallic coating F in a state of ions, and the metal can include Cu, Ni, Ag, Au, or the like. The electrolyte S can be obtained by dissolving (ionizing) these metals with an acid, such as nitric acid, phosphoric acid, succinic acid, sulfuric acid, or pyrophosphoric acid.

Furthermore, the film formation device 1 of this embodiment includes an elevating device 15 on the top of the housing 13, and the elevating device 15 moves up and down the housing 13. The elevating device 15 is a device that moves up and down the housing 13 in an interval from a position at which the solid electrolyte membrane 12 is separated from the substrate W to a position at which the solid electrolyte membrane 12 contacts the substrate W (see FIG. 1A to FIG. 1C). It is only necessary that the elevating device 15 can move up and down the housing 13, and the elevating device 15 can include a hydraulic or pneumatic cylinder, an electrically operated actuator, a linear guide, a motor, and the like. While FIG. 1A to FIG. 1C illustrate the elevating device 15 in the same shape, the distal end of the elevating device 15 is advanced to the substrate W side from a device main body (not illustrated) that secures the elevating device 15 in the elevating devices 15 of FIG. 1B and FIG. 1C compared with the elevating device 15 illustrated in FIG. 1A.

The housing 13 is provided with a supply port 13*a* through which the electrolyte S is supplied and a discharge port 13*b* through which the electrolyte S is discharged. The supply port 13*a* and discharge port 13*b* are connected to a tank 21 via piping. The electrolyte S sent out from the tank 21 by a pump 22 flows into the housing 13 from the supply port 13*a*, is discharged from the discharge port 13*b*, and returns to the tank 21. A pressure adjusting valve 23 is disposed in a downstream side of the discharge port 13*b*, thus allowing pressurizing the electrolyte S in the housing 13 with a predetermined pressure by the pressure adjusting valve 23 and the pump 22 (a pressing mechanism 20).

In the film formation, the substrate W in contact with the solid electrolyte membrane 12 can be pressed by the solid electrolyte membrane 12 with a fluid pressure of the electrolyte S (see FIG. 1C). Accordingly, the metallic coating F can be formed on the substrate W while uniformly pressurizing the substrate W by the solid electrolyte membrane 12. The pressure adjusting valve 23 and the pump 22 correspond to the "pressing mechanism" in the present disclosure.

The film formation device 1 of this embodiment includes a metal pedestal 16 on which the substrate W is placed, and the metal pedestal 16 is electrically connected to a negative electrode of the power supply unit 14. Therefore, the substrate W is electrically conductive to the negative electrode of the power supply unit 14. A positive electrode of the power supply unit 14 is electrically connected (electrically conductive) to the anode 11 included in the housing 13. The power supply unit 14 may be any of a direct current power source or an alternating current power source insofar as the film formation can be performed, and may include both of them. In this case, the direct current power source may be used in the film formation and an etching described later, and the alternating current power source may be used in a measurement of an alternating current impedance.

Now, in the film formation, when air is entrained between the solid electrolyte membrane 12 and the substrate W, the solid electrolyte membrane 12 is partially not in contact with the substrate W due to the air. Therefore, since the distribution of current density becomes uneven, burnt deposit and/or spot of the metallic coating F are easily generated in a high current density portion.

However, as described in an example described later, the inventors have found that an imaginary component Z" of an alternating current impedance value serves as an index of a contact state between the solid electrolyte membrane 12 and the substrate W. Accordingly, the inventors focused on estimating a state where the air was entrained between the solid electrolyte membrane 12 and the substrate W by the measurement of the alternating current impedance and re-tensioning the solid electrolyte membrane 12 to release the entrained air. Therefore, in this embodiment, the film formation device 1 further includes the re-tensioning mechanism 30, the impedance measurement device 40, and the control device 50. Here, the re-tensioning of the solid electrolyte membrane 12 means giving a constant tensile force to the solid electrolyte membrane 12 again after the tensile force of the solid electrolyte membrane 12 is relieved.

The re-tensioning mechanism 30 re-tensions the solid electrolyte membrane 12 mounted to the housing 13 with the constant tensile force. The re-tensioning mechanism 30 is a device that moves in the up-down direction along a wall surface of the housing 13 by a drive unit (not illustrated) in a state where a peripheral edge of the solid electrolyte membrane 12 is secured by sandwiching and the like. The solid electrolyte membrane 12 is in contact with the housing 13 in an unconfined manner. Here, the tensile force of the solid electrolyte membrane 12 is relieved when the re-tensioning mechanism 30 moves downward with respect to the housing 13, and the tensile force is given to the solid electrolyte membrane 12 when the re-tensioning mechanism 30 moves upward. The adjustment of the tensile force of the solid electrolyte membrane 12 may be set by adjusting a position of the re-tensioning mechanism 30 from a lower end of the housing 13. For example, the re-tensioning mechanism 30 may measure a load of pulling the solid electrolyte membrane 12 to measure the tensile force from the load. Thus, the re-tensioning mechanism 30 is disposed to the housing 13, and re-tensions the solid electrolyte membrane 12 with the constant tensile force after relieving the tensile force of the solid electrolyte membrane 12. In this embodiment, the re-tensioning mechanism 30 outputs a completion signal indicating the re-tensioning completion to the control device 50 (specifically, re-tensioning execution unit 55) after the re-tensioning of the solid electrolyte membrane 12.

The impedance measurement device 40 is a device that measures an alternating current impedance between the anode 11 and the substrate W. In the measurement, the impedance measurement device 40 changes a voltage applied between the anode 11 and the substrate W that serves as the cathode from a high frequency to a low frequency in a state where the solid electrolyte membrane 12 is in contact with the substrate W. The impedance measurement device 40 includes a counter electrode 41, a working electrode 42, and a reference electrode 43, and includes a potentio/galvanostat that controls the current and the voltage and a frequency response analyzer (FRA) that controls a frequency while not illustrated.

The counter electrode 41 disposed to the anode 11, the working electrode 42 disposed to the substrate W, and the reference electrode 43 disposed between the anode 11 and the solid electrolyte membrane 12 are mounted to the film formation device 1 of this embodiment.

In detail, the counter electrode 41 penetrates the housing 13. The counter electrode 41 has one end portion electrically connected to the anode 11 and the other end portion exposed outside. The working electrode 42 penetrates the metal pedestal 16. The working electrode 42 has one end portion electrically connected to the substrate W and the other end portion exposed outside. The reference electrode 43 penetrates the housing 13. The reference electrode 43 has one end portion in contact with the electrolyte S and the other end portion exposed outside. When the solid electrolyte membrane 12 is in contact with the surface of the anode 11, the reference electrode 43 may be disposed such that the one end portion of the reference electrode 43 is inserted into the solid electrolyte membrane 12 and the other end portion is exposed outside.

The other end portions of the counter electrode 41, the working electrode 42, and the reference electrode 43 are connected to the potentio/galvanostat with the frequency response analyzer. Therefore, the alternating current impedance of the portion including the solid electrolyte membrane 12 and the substrate W in contact therewith can be measured. The materials of the counter electrode 41, the working electrode 42, and the reference electrode 43 only need to be materials not corrosive to the electrolyte S, and can include platinum (Pt) or the like.

The control device 50 is a device that controls at least the elevating by the elevating device 15, the pressing by the pressing mechanism 20, the applying the voltage by the power supply unit 14, the execution of the measurement by the impedance measurement device 40, and the re-tensioning by the re-tensioning mechanism 30.

The control device 50 has a basic configuration that includes an arithmetic device, such as a CPU, a storage device, such as a RAM and a ROM, as hardware. The arithmetic device, for example, identifies the imaginary component Z"a at a predetermined frequency, and determines whether the imaginary component Z"a at the predetermined frequency is equal to or more than a film-formable value or not. The storage device stores a preliminarily set film-formable value, the imaginary component of the measured alternating current impedance value, and the like.

In this embodiment, the control device 50 receives signals from an input device (not illustrated), the re-tensioning mechanism 30, the impedance measurement device 40, and the like. The control device 50 is electrically connected to the elevating device 15, the pressing mechanism 20, the power supply unit 14, the impedance measurement device 40, and the re-tensioning mechanism 30 so as to be allowed to control them.

Figure 2:
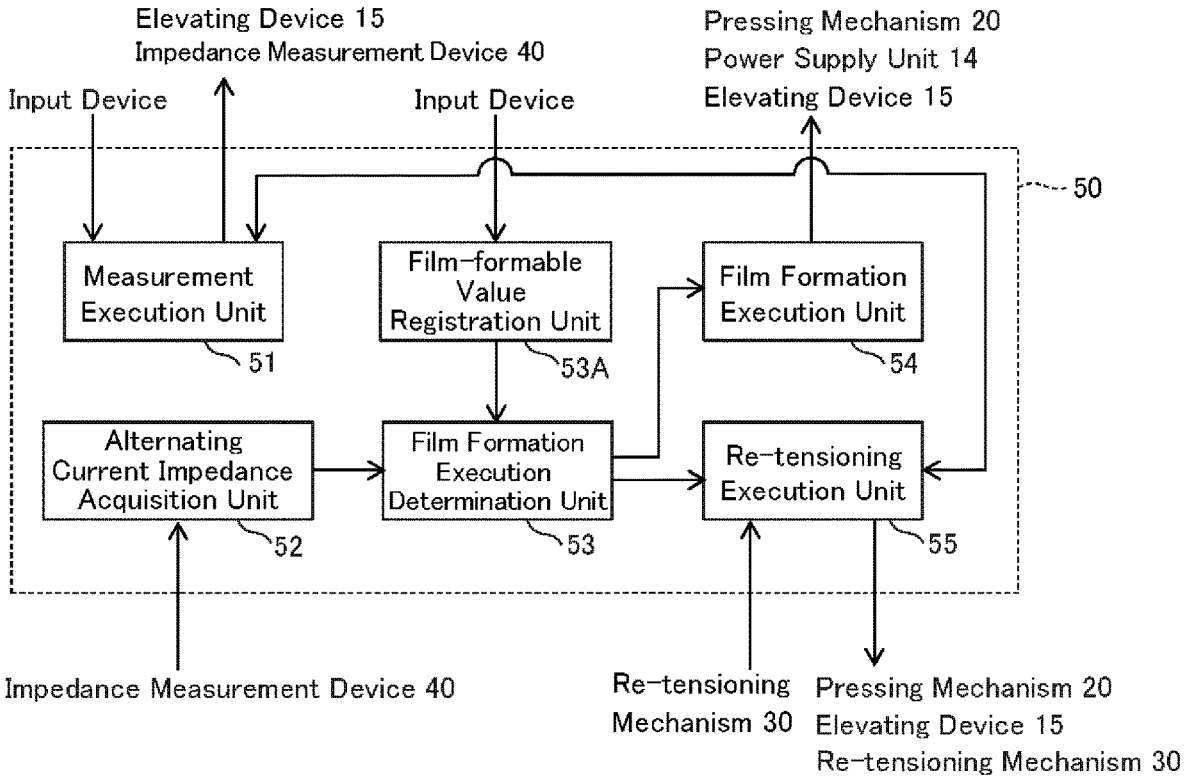
FIG. 2 is a block diagram of a control device of the film formation device illustrated in FIG. 1A.

As illustrated in FIG. 2, the control device 50 includes at least a measurement execution unit 51, a film formation execution determination unit 53, a film formation execution unit 54, and a re-tensioning execution unit 55, which correspond to software of the control device 50. In this embodiment, the control device 50 further includes an alternating current impedance acquisition unit 52 and a film-formable value registration unit 53A as software.

The measurement execution unit 51 outputs a control signal that causes the elevating device 15 to move down the housing 13 to a position at which the solid electrolyte membrane 12 contacts the substrate W (see FIG. 1B). Specifically, the measurement execution unit 51 controls a pressure of a working fluid supplied to a cylinder when the elevating device 15 is a hydraulic or pneumatic cylinder. The measurement execution unit 51 controls a current supplied to an actuator when the elevating device 15 is an electrically operated actuator, and further, controls a rotation when the elevating device 15 is a motor or the like.

The measurement execution unit 51 causes the impedance measurement device 40 to execute the measurement of the alternating current impedance. Specifically, the measurement execution unit 51 controls the potentio/galvanostat and the frequency response analyzer to measure the alternating current impedance between the anode 11 and the substrate W by changing the voltage applied therebetween from a high frequency to a low frequency.

The alternating current impedance acquisition unit 52 acquires the alternating current impedance value from the impedance measurement device 40, which is caused to measure by the measurement execution unit 51. Here, a description will be given of the alternating current impedance value that indicates the measurement result of the alternating current impedance. The alternating current impedance value is a complex number, and includes a real component Z' and an imaginary component Z".

For example, when the contact state between the solid electrolyte membrane 12 and the substrate W is poor like the case where the air is entrained between the solid electrolyte membrane 12 and the substrate W, capacitance easily increases, thus easily decreasing the imaginary component Z" of the alternating current impedance value. Therefore, in this embodiment, the imaginary component Z" of the alternating current impedance value is used as an index indicating the contact state between the solid electrolyte membrane 12 and the substrate W.

Accordingly, in this embodiment, in the acquisition, the alternating current impedance acquisition unit 52 may acquire at least the imaginary components Z" of the real components Z' and the imaginary components Z" of the measured alternating current impedance values at the respective frequencies. When a Cole-Cole plot diagram (see, for example, FIG. 9) is made as the measurement result of the alternating current impedance, the alternating current impedance acquisition unit 52 may acquire the real components Z' and the imaginary components Z" of the alternating current impedance values at the respective frequencies.

The film-formable value registration unit 53A acquires the film-formable value by, for example, the input from the input device (not illustrated), and registers it. The film-formable value is a preliminarily set value at which the film formation becomes performable. The film-formable value is acquired in advance through a test using the film formation device 1, and is the imaginary component of the alternating current impedance value at a predetermined frequency when the film formation state of the substrate W is good. Accordingly, the film-formable value is a value indicating that the contact state between the solid electrolyte membrane 12 and the substrate W is good, and the film formation performed when the imaginary component Z"a at the predetermined frequency is equal to or more than the film-formable value allows the film formation in the good film formation state.

The film formation execution determination unit 53 reads the imaginary components Z" of the alternating current impedances at the respective frequencies, and identifies the imaginary component Z"a of the alternating current impedance at the predetermined frequency (hereinafter referred to as the "imaginary component Z"a at the predetermined frequency") from the read imaginary components Z". In this embodiment, the imaginary component Z"a at the predetermined frequency indicates the contact state between the solid electrolyte membrane 12 and the substrate W. Here, while the predetermined frequency is not specifically limited, the predetermined frequency is a frequency within a specific frequency range in some embodiments. The specific frequency range is a frequency range with which whether the film formation is performable or not is accurately determinable in some embodiments, and can include, for example, a range of 10 kHz to 100 Hz.

The film formation execution determination unit 53 reads the film-formable value from the film-formable value registration unit 53A, and determines whether the imaginary component Z"a at the predetermined frequency is equal to or more than the film-formable value or not and determines whether to permit the film formation of the metallic coating F or not.

Specifically, when the imaginary component Z"a at the predetermined frequency is determined to be equal to or more than the film-formable value, the film formation execution determination unit 53 determines to permit the film formation of the metallic coating F, and transmits a determination signal indicating the permission of the film formation to the film formation execution unit 54. On the other hand, when the imaginary component Z"a is determined to be smaller than the film-formable value, the film formation execution determination unit 53 determines to inhibit the film formation of the metallic coating F, and transmits a determination signal indicating the inhibition of the film formation to the re-tensioning execution unit 55. Accordingly, it can be estimated before the film formation that the air is entrained between the solid electrolyte membrane 12 and the substrate W.

The film formation execution unit 54 forms the metallic coating F when the film formation execution determination unit 53 has determined to permit the film formation (see FIG. 1C). During the forming of the metallic coating F, the film formation execution unit 54 causes the pressing mechanism 20 to press the substrate W by the solid electrolyte membrane 12 and causes the power supply unit 14 to apply the voltage between the anode 11 and the substrate W. During the pressing by the pressing mechanism 20, the film formation execution unit 54 operates the pump 22 and controls the pressure adjusting valve 23 so as to have a pressing force for forming the metallic coating F.

The film formation execution unit 54 terminates the film formation of the metallic coating F when the metallic coating F is formed with a predetermined film thickness. When the film formation terminates, the film formation execution unit 54 causes the power supply unit 14 to release applying the voltage between the anode 11 and the substrate W, and causes the pressing mechanism 20 to release the pressing of the substrate W by the solid electrolyte membrane 12. During the release by the pressing mechanism 20, the film formation execution unit 54 stops the pump 22.

The film formation execution unit 54 causes the elevating device 15 to move up the housing 13 to a position at which the solid electrolyte membrane 12 separates from the substrate W (see FIG. 1A). When the elevating device 15 is a cylinder, an actuator, a motor, or the like, the control method is similar to that of the measurement execution unit 51 described above.

The re-tensioning execution unit 55 causes the pressing mechanism 20 to release the pressing of the substrate W by the solid electrolyte membrane 12 when the film formation execution determination unit 53 determines to inhibit the film formation. During the release by the pressing mechanism 20, the re-tensioning execution unit 55 stops the pump 22. The re-tensioning execution unit 55 causes the elevating device 15 to move up the housing 13 to the position at which the solid electrolyte membrane 12 separates from the substrate W (see FIG. 1A). When the elevating device 15 is a cylinder, an actuator, a motor, or the like, the control method is similar to that of the measurement execution unit 51 described above.

Furthermore, the re-tensioning execution unit 55 causes the re-tensioning mechanism 30 to re-tension the solid electrolyte membrane 12 with a constant tensile force. The re-tensioning execution unit 55 controls the drive unit (not illustrated) included in the re-tensioning mechanism 30. The re-tensioning allows removing wrinkles of the solid electrolyte membrane 12 as the cause of the air entrainment, and consequently, the air entrainment between the solid electrolyte membrane 12 and the substrate W is suppressed. In addition, the re-tensioning execution unit 55 causes the measurement execution unit 51 to execute the measurement of the alternating current impedance by the impedance measurement device 40 after completion of the re-tensioning.

2. Film Formation Method for Metallic Coating F

Figure 3:
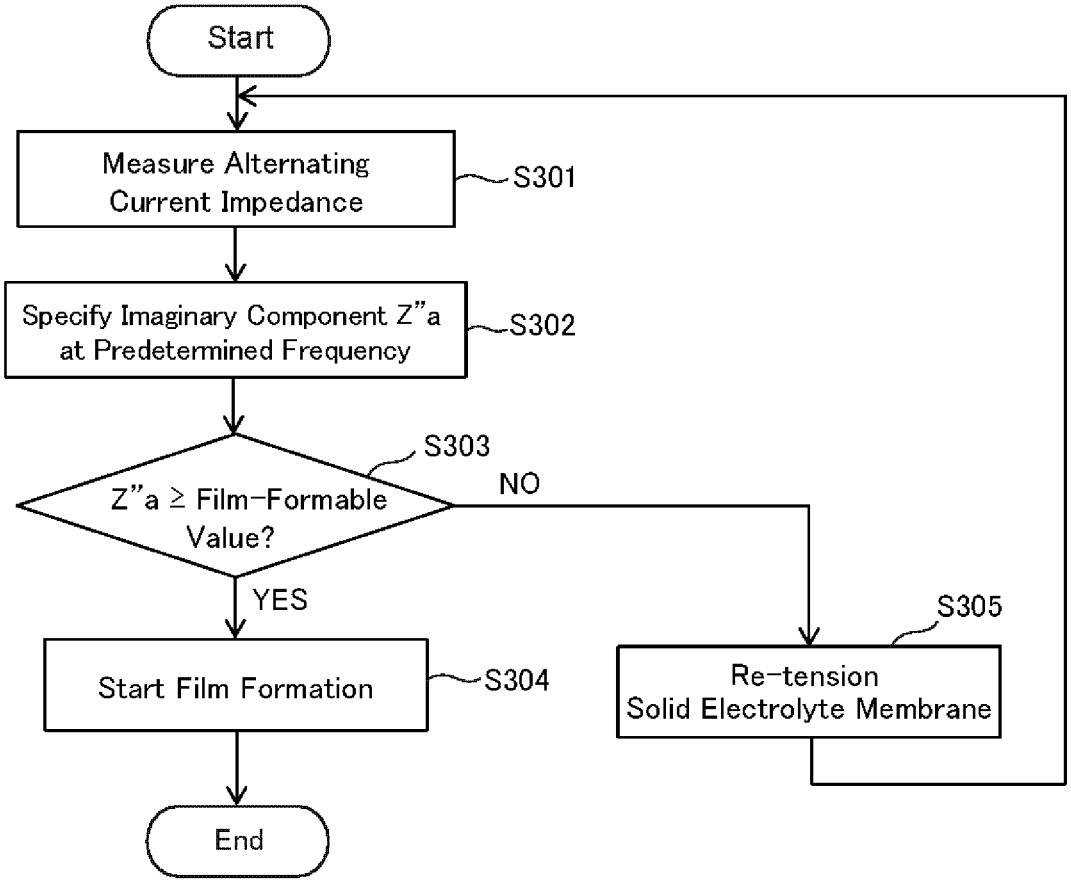
FIG. 3 is a flowchart of a film formation method for a metallic coating using the film formation device illustrated in FIG. 1A.

With reference to FIG. 1A to FIG. 1C, FIG. 2, and FIG. 3, the film formation method for the metallic coating F according to the embodiment will be described. FIG. 3 is a flowchart of the film formation method for the metallic coating F using the film formation device 1 illustrated in FIG. 1A.

First, at Step S301, as illustrated in FIG. 1B, the alternating current impedance between the anode 11 and the substrate W is measured in the state where the solid electrolyte membrane 12 is in contact with the substrate W. Specifically, as illustrated in FIG. 1A and FIG. 1B, for example, by the input of the input device (not illustrated), the measurement execution unit 51 causes the elevating device 15 to move down the housing 13 to the position at which the solid electrolyte membrane 12 contacts the substrate W placed on the metal pedestal 16.

In this contact state, the measurement execution unit 51 causes the impedance measurement device 40 to execute the measurement of the alternating current impedance. Here, in the state where the solid electrolyte membrane 12 is in contact with the substrate W, the pressing mechanism 20 does not need to press the substrate W by the solid electrolyte membrane 12, or may press the substrate W by the solid electrolyte membrane 12 insofar as the alternating current impedance can be measured. However, in consideration of more accurately determining the contact state between the solid electrolyte membrane 12 and the substrate in the film formation, the substrate W is pressed by the solid electrolyte membrane 12 under the condition of the pressing force for forming the metallic coating F in some embodiments.

In the measurement of the alternating current impedance, the impedance measurement device 40 measures the alternating current impedance between the anode 11 and the substrate W by changing the voltage applied between the anode 11 and the substrate W that serves as the cathode from the high frequency to the low frequency. The impedance measurement device 40 outputs the measured alternating current impedance values at the respective frequencies to the alternating current impedance acquisition unit 52, and the alternating current impedance acquisition unit 52 acquires at least the imaginary components Z" of the alternating current impedance values at the respective frequencies.

Next, at Step S302, the imaginary component Z"a at the predetermined frequency is identified from the acquired alternating current impedance values. Specifically, the film formation execution determination unit 53 reads the imaginary components Z" of the alternating current impedances at the respective frequencies acquired by the alternating current impedance acquisition unit 52, and identifies the imaginary component Z"a at the predetermined frequency (for example, 10 kHz) from the read imaginary components Z".

While the case where the imaginary component Z"a at the predetermined frequency is identified from the acquired imaginary components Z" of the alternating current impedances at the respective frequencies is described here, this should not be construed in a limiting sense. For example, when the real components Z' are acquired together with the imaginary components Z" of the alternating current impedances at the respective frequencies, the film formation execution determination unit 53 may create a Cole-Cole plot diagram having a coordinate system in which the X-axis indicates the real component Z' and the Y-axis indicates the imaginary component Z". In addition, the film formation execution determination unit 53 may identify the imaginary component Z"a at the predetermined frequency from the created Cole-Cole plot diagram.

Next, at Step S303, it is determined whether the imaginary component Z"a at the predetermined frequency indicating the contact state between the solid electrolyte membrane 12 and the substrate W, of the alternating current impedance, is equal to or more than the preliminarily set film-formable value at which the film formation becomes performable or not.

Specifically, the film formation execution determination unit 53 reads the film-formable value at the same frequency as the imaginary component Z"a at the predetermined frequency from the film-formable value registration unit 53A. For example, when the predetermined frequency is 10 kHz, the film-formable value at 10 kHz (for example, −0.220Ω) is read. Next, the film formation execution determination unit 53 determines whether the imaginary component Z"a at the predetermined frequency is equal to or more than the film-formable value or not.

In this determination, when the imaginary component Z"a at the predetermined frequency is equal to or more than the film-formable value, the film formation execution determination unit 53 determines to permit the film formation of the metallic coating F. In the case of the determination of permitting the film formation (Step S303: YES), the film formation of the metallic coating F described later is performed (advanced to Step S304).

On the other hand, when the imaginary component Z"a at the predetermined frequency is smaller than the film-formable value, the film formation execution determination unit 53 determines to inhibit the film formation of the metallic coating F. This allows detecting the air entrainment between the solid electrolyte membrane 12 and the substrate W before the film formation. In the case of the determination of inhibiting the film formation (Step S303: NO), the re-tensioning of the solid electrolyte membrane 12 described later is performed (advanced to Step S305).

At Step S304, as illustrated in FIG. 1C, since the imaginary component Z"a at the predetermined frequency is equal to or more than the film-formable value, the metallic coating F is formed in the state where the substrate W is pressed by the solid electrolyte membrane 12.

Specifically, when the film formation execution determination unit 53 has determined to permit the film formation, the film formation execution unit 54 causes the pressing mechanism 20 to press the substrate W by the solid electrolyte membrane 12 under a pressure condition for forming the metallic coating F. Consequently, the electrolyte S is pressurized by the pump 22, the solid electrolyte membrane 12 follows the substrate W, and the pressure adjusting valve 23 makes the pressure of the electrolyte S in the housing 13 a set constant pressure. That is, the solid electrolyte membrane 12 can uniformly press the surface of the substrate W with the adjusted fluid pressure of the electrolyte S in the housing 13.

Next, the film formation execution unit 54 causes the power supply unit 14 to apply the voltage between the anode 11 and the substrate W, thus forming the metallic coating F. Accordingly, the metallic coating F derived from the metal ions can be formed on the surface of the substrate W.

When the metallic coating F is formed with a predetermined layer thickness, the film formation execution unit 54 causes the power supply unit 14 to release application of the voltage between the anode 11 and the substrate W and causes the pressing mechanism 20 to release the pressing of the substrate W by the solid electrolyte membrane 12. Subsequently, the film formation execution unit 54 causes the elevating device 15 to move up the housing 13 to a predetermined height (see FIG. 1A), and separates the solid electrolyte membrane 12 from the substrate W in the state where the metallic coating F is formed on the surface.

In this embodiment, since the film formation is performed when the imaginary component Z"a at the predetermined frequency is equal to or more than the film-formable value, a poor film formation, such as spot and burnt deposit, caused by a contact failure between the solid electrolyte membrane 12 and the substrate W can be suppressed. Accordingly, the film formation can be continuously performed to a plurality of the substrates W in the good film formation state.

At Step S305, since the imaginary component Z"a at the predetermined frequency is smaller than the film-formable value, the pressing of the substrate W by the solid electrolyte membrane 12 is released, the solid electrolyte membrane 12 is separated from the substrate W, and the solid electrolyte membrane 12 is re-tensioned with a constant tensile force.

Specifically, when the film formation execution determination unit 53 has determined to inhibit the film formation, the re-tensioning execution unit 55 causes the pressing mechanism 20 to release the pressing of the substrate W by the solid electrolyte membrane 12. Subsequently, the re-tensioning execution unit 55 causes the elevating device 15 to move up the housing 13 to the position at which the solid electrolyte membrane 12 separates from the substrate W (see FIG. 1A).

After the moving up, the re-tensioning execution unit 55 causes the re-tensioning mechanism 30 to re-tension the solid electrolyte membrane 12 with the constant tensile force. The re-tensioning mechanism 30 relieves the tensile force of the solid electrolyte membrane 12, and subsequently, re-tensions the solid electrolyte membrane with the uniform tensile force so as to remove the wrinkles as the cause of the air entrainment. Accordingly, even when the solid electrolyte membrane 12 is wrinkled during continuously forming the metallic coating F on the plurality of the substrates W, the wrinkles can be removed.

After the re-tensioning, the re-tensioning mechanism 30 outputs the completion signal indicating the re-tensioning completion to the re-tensioning execution unit 55. The re-tensioning execution unit 55 having received the signal causes the measurement execution unit 51 to execute the measurement of the alternating current impedance by the impedance measurement device 40.

Accordingly, the measurement of the alternating current impedance (Step S301), the identification of the imaginary component Z"a at the predetermined frequency (Step S302), and the determination of whether the imaginary component Z"a at the predetermined frequency is equal to or more than the film-formable value or not (Step S303) described above are performed, thus re-tensioning the solid electrolyte membrane 12 until the imaginary component Z"a at the predetermined frequency becomes equal to or more than the film-formable value. Finally, the metallic coating F can be formed in the state where the substrate W is pressed by the solid electrolyte membrane 12 that is re-tensioned to remove the wrinkle.

While the case where the re-tensioning execution unit 55 having received the completion signal from the re-tensioning mechanism 30 executes the measurement of the alternating current impedance by the measurement execution unit 51 is described here, this should not be construed in a limiting sense. The re-tensioning execution unit 55 having received the completion signal may cause the film formation execution unit 54 to execute the film formation of the metallic coating F using the re-tensioned solid electrolyte membrane 12.

According to the film formation method for the metallic coating F of this embodiment, when the air is entrained between the solid electrolyte membrane 12 and the substrate W, the capacitance increases, and therefore, the imaginary component Z" of the alternating current impedance value decreases. Therefore, by determining whether the imaginary component Z"a at the predetermined frequency is equal to or more than the film-formable value or not, it can be detected before the film formation that the air is entrained between the solid electrolyte membrane 12 and the substrate W. Since the solid electrolyte membrane 12 can be re-tensioned until the imaginary component Z"a at the predetermined frequency reaches the film-formable value, the air entrainment between the solid electrolyte membrane 12 and the substrate W can be suppressed.

As described above, according to the film formation method and the film formation device 1 for the metallic coating F of this embodiment, the metallic coating can be formed while avoiding the occurrence of the spot and the burnt deposit. Especially, also in the continuous film formation on the plurality of the substrates W, the metallic coating F can be formed while avoiding the occurrence of the spot and the burnt deposit.

Second Embodiment

Figure 4:
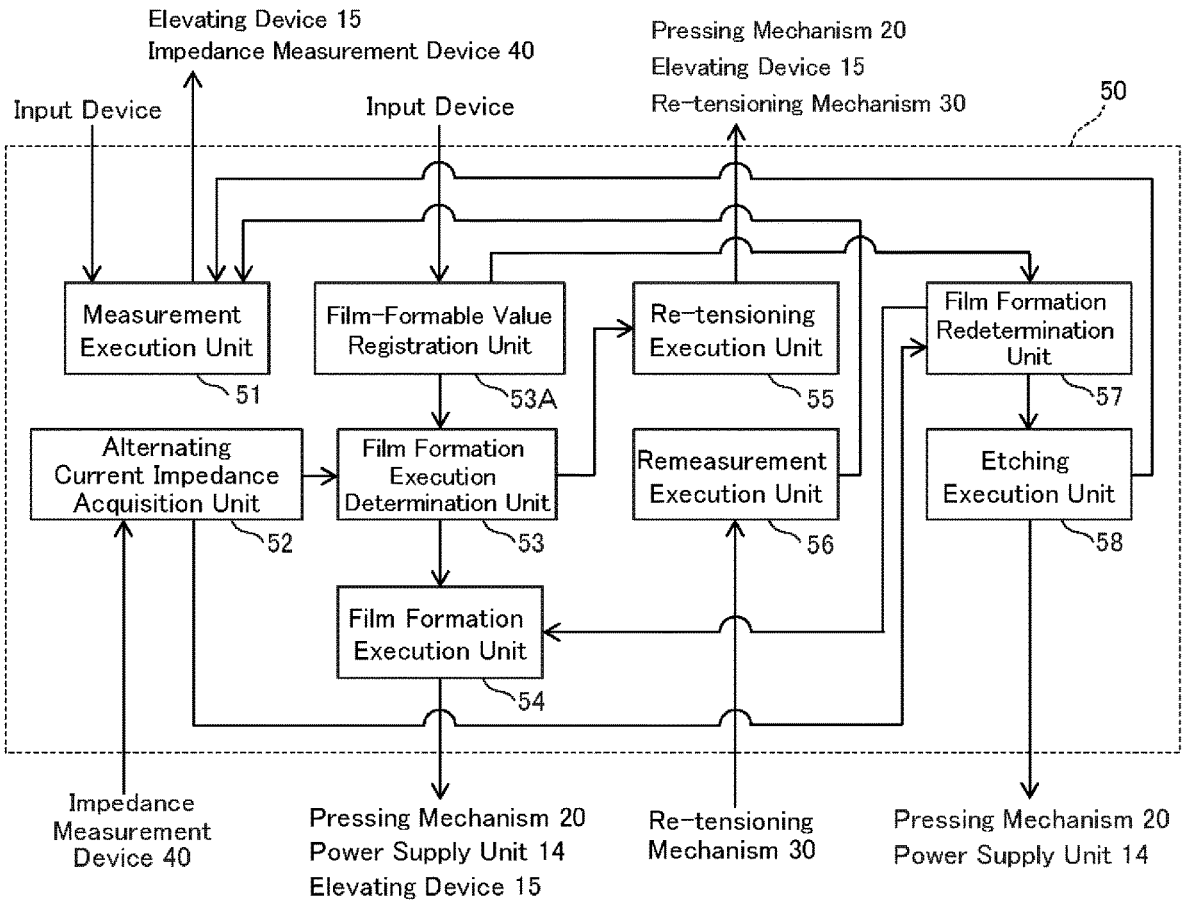
FIG. 4 is a block diagram for describing a control device according to a second embodiment of the film formation device illustrated in FIG. 1A.

FIG. 4 is a block diagram for describing a control device 50 according to a second embodiment of the film formation device 1 illustrated in FIG. 1A. As described above, even when the air entrainment between the solid electrolyte membrane 12 and the substrate W is suppressed by the re-tensioning, the imaginary component Z"a at the predetermined frequency does not reach the film-formable value in some cases when an oxide is formed on the surface of the substrate W in contact with the solid electrolyte membrane 12.

Therefore, in the second embodiment, when the imaginary component Z"a at the predetermined frequency is smaller than the film-formable value after performing the re-tensioning once, an etching of the surface of the substrate W is performed. This is the point different from the first embodiment. Accordingly, the following describes the difference, and the same reference numerals are attached to devices and portions the same as those in the above-described embodiment, thus omitting their detailed descriptions.

As illustrated in FIG. 4, the control device 50 of this embodiment includes a remeasurement execution unit 56, a film formation redetermination unit 57, and an etching execution unit 58 in addition to the above-described configuration of the control device 50 of the first embodiment illustrated in FIG. 2.

The remeasurement execution unit 56 receives the completion signal indicating the re-tensioning completion from the re-tensioning mechanism 30. At the timing of receiving the completion signal, the remeasurement execution unit 56 causes the measurement execution unit 51 to execute the measurement (remeasurement) of the alternating current impedance by the impedance measurement device 40 after the re-tensioning. The measurement by the measurement execution unit 51 is as described above.

Similarly to the film formation execution determination unit 53, the film formation redetermination unit 57 identifies the imaginary component Z"a at the predetermined frequency, determines whether the imaginary component Z"a at the predetermined frequency is equal to or more than the film-formable value or not, and determines whether to permit the film formation of the metallic coating F or not.

However, in the determination, when the imaginary component Z"a at the predetermined frequency is smaller than the film-formable value, the film formation redetermination unit 57 determines to inhibit the film formation of the metallic coating F and permit the etching of the substrate W. The film formation redetermination unit 57 transmits a determination signal indicating the inhibition of the film formation to the film formation execution unit 54, and transmits a determination signal indicating the permission of the etching to the etching execution unit 58. Accordingly, it can be estimated before the film formation that the oxide is formed on the surface of the substrate.

When the film formation redetermination unit 57 has determined to permit the etching, the etching execution unit 58 causes the pressing mechanism 20 to press the substrate W by the solid electrolyte membrane 12. In this pressing state, the etching execution unit 58 causes the power supply unit 14 to invert the poles of the anode 11 and the substrate W that serves as the cathode, and to apply the voltage between the anode 11 and the substrate W, thereby etching the surface of the substrate W (see FIG. 6). Accordingly, the oxide on the surface of the substrate W can be removed. At the timing of the etching completion, the etching execution unit 58 causes the measurement execution unit 51 to execute the measurement of the alternating current impedance by the impedance measurement device 40.

Figure 5:
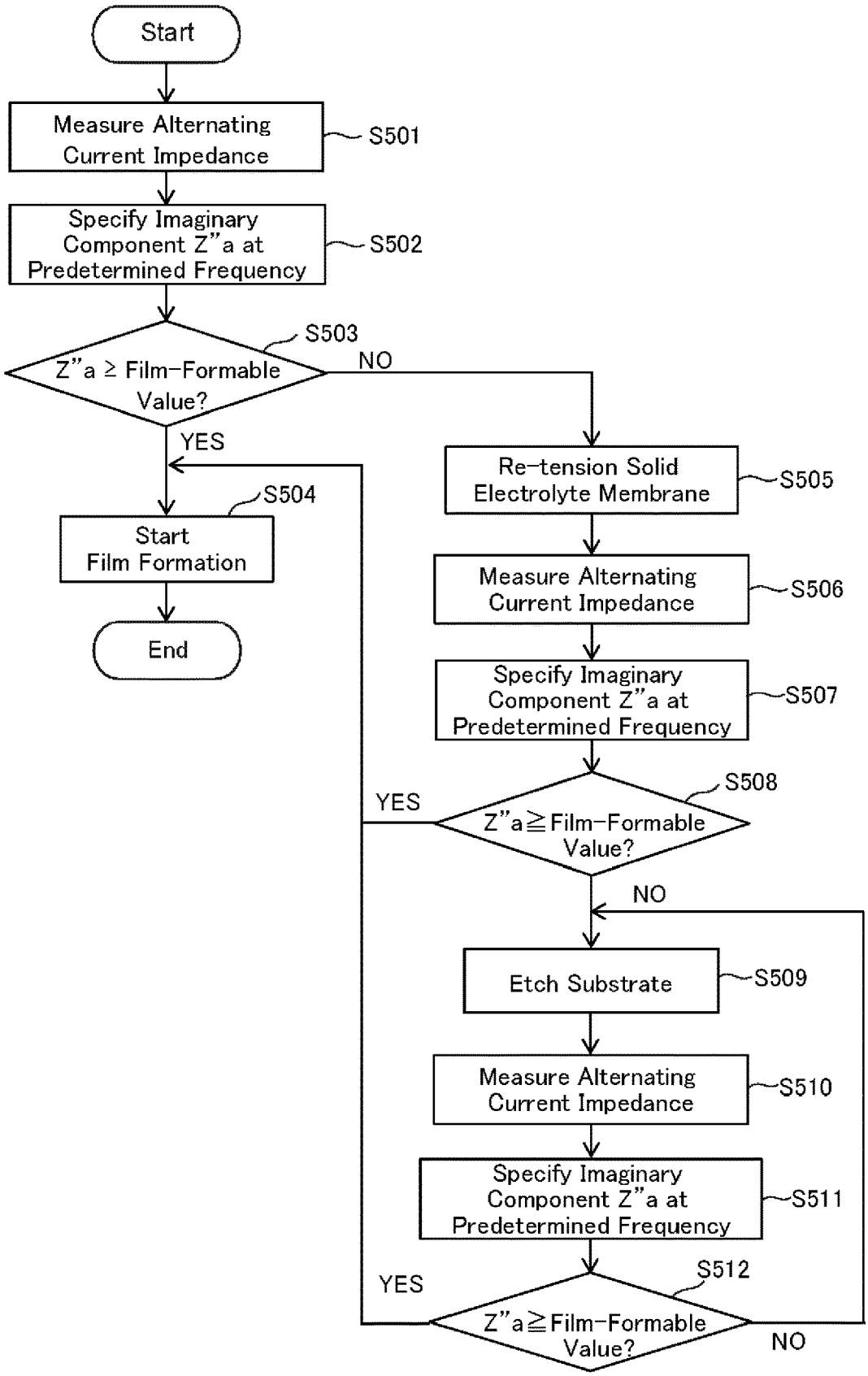
FIG. 5 is a flowchart of a film formation method for a metallic coating according to the second embodiment of the film formation device illustrated in FIG. 1A.
Figure 6:
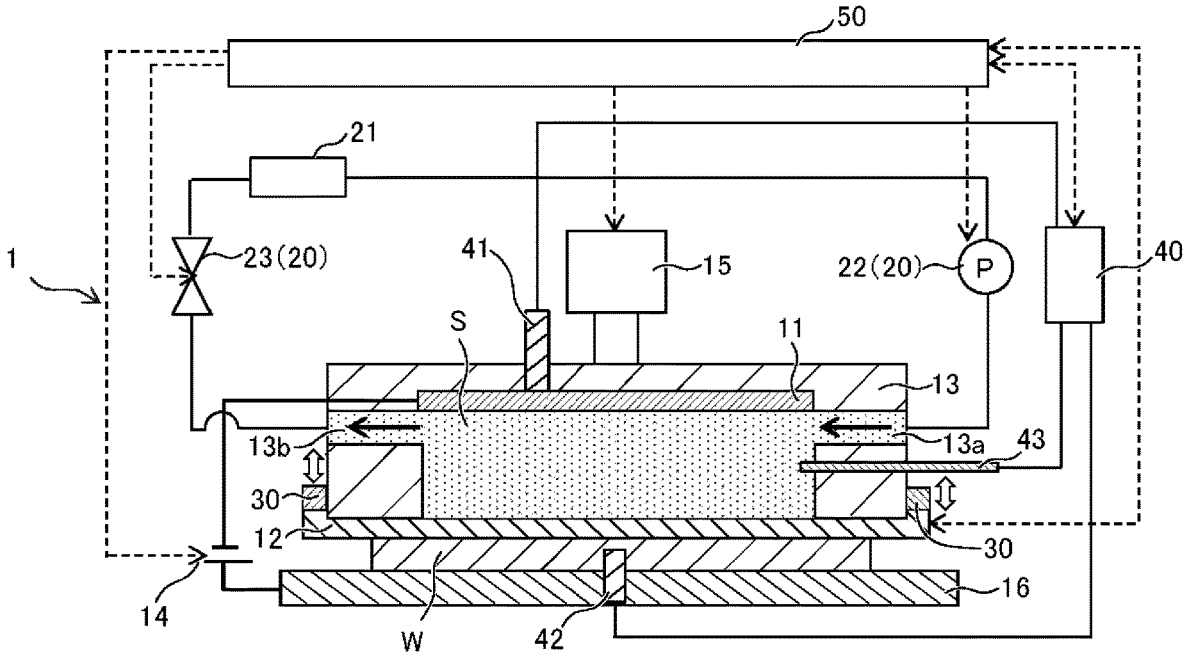
FIG. 6 is a schematic cross-sectional view for describing an etching in the second embodiment of the film formation device illustrated in FIG. 1A.

The following describes the film formation method for the metallic coating F according to the second embodiment by referring to FIG. 5 and FIG. 6.

First, Step S501 to Step S504 are the same as Step S301 to Step S304 of the above-described embodiment. Briefly describing, as illustrated in FIG. 5, at Step S501, the measurement execution unit 51 measures the alternating current impedance between the anode 11 and the substrate W (see FIG. 1A and FIG. 1B). Next, at Step S502, the alternating current impedance acquisition unit 52 identifies the imaginary component Z"a at the predetermined frequency. Next, at Step S503, the film formation execution determination unit 53 determines whether the imaginary component Z"a at the predetermined frequency is equal to or more than the film-formable value or not. In this determination, when the imaginary component Z"a at the predetermined frequency is equal to or more than the film-formable value (Step S503: YES), the process advances to Step S504, and the film formation execution unit 54 forms the metallic coating F (see FIG. 1C).

On the other hand, when the imaginary component Z"a at the predetermined frequency is smaller than the film-formable value (Step S503: NO), the process advances to Step S505. At Step S505, the alternating current impedance acquisition unit 52 re-tensions the solid electrolyte membrane 12 with the constant tensile force. Here, the solid electrolyte membrane 12 is re-tensioned with the constant tensile force similarly to Step S305 except that the re-tensioning mechanism 30 outputs the completion signal indicating the re-tensioning completion to the remeasurement execution unit 56. Accordingly, the wrinkles of the solid electrolyte membrane 12 as the cause of air entrainment can be removed.

Next, at Step S506, in the state where the re-tensioned solid electrolyte membrane 12 is brought in contact with the substrate W, the alternating current impedance between the anode 11 and the substrate W is measured (remeasured). Specifically, the remeasurement execution unit 56 having received the completion signal from the re-tensioning mechanism 30 causes the measurement execution unit 51 to execute the measurement of the alternating current impedance by the impedance measurement device 40. The measurement of the alternating current impedance is performed similarly to the measurement of the alternating current impedance at Step S301. The output of the alternating current impedance value by the impedance measurement device 40 and the acquisition of the alternating current impedance value by the alternating current impedance acquisition unit 52 are also similar to those at Step S301.

While the case where the remeasurement execution unit 56 directly receives the completion signal from the re-tensioning mechanism 30 is described here, this should not be construed in a limiting sense. For example, the re-tensioning mechanism 30 may output the completion signal to the re-tensioning execution unit 55, and the remeasurement execution unit 56 may receive the completion signal via the re-tensioning execution unit 55.

Next, at Step S507, the imaginary component Z"a at the predetermined frequency is identified from the acquired alternating current impedance values. The identification of the imaginary component Z"a at the predetermined frequency by the film formation redetermination unit 57 is similar to the identification by the film formation execution determination unit 53 at Step S302.

Next, at Step S508, it is determined (redetermined) whether the imaginary component Z"a at the predetermined frequency of the remeasured alternating current impedance is equal to or more than the film-formable value or not. Specifically, the film formation redetermination unit 57 determines whether the imaginary component Z"a at the predetermined frequency is equal to or more than the film-formable value or not, and determines to permit the film formation of the metallic coating F when the identified imaginary component Z"a at the predetermined frequency is equal to or more than the film-formable value (Step S508: YES). In this case, the process returns to Step S504, and the metallic coating F is formed in the state where the substrate W is pressed by the re-tensioned solid electrolyte membrane 12.

On the other hand, when the imaginary component Z"a at the predetermined frequency is smaller than the film-formable value, the film formation redetermination unit 57 determines to inhibit the film formation of the metallic coating F and permit the etching of the substrate W (Step S508: NO). Accordingly, it can be detected before the film formation that the oxide is formed on the surface of the substrate. In this case, the process advances to Step S509, and the etching of the substrate W described later is performed.

At Step S509, as illustrated in FIG. 6, in the state where the substrate W is pressed by the re-tensioned solid electrolyte membrane 12, the poles of the anode 11 and the substrate W that serves as the cathode are inverted, and subsequently, the voltage is applied between the anode 11 and the substrate W, thereby etching the surface of the substrate W.

Specifically, the etching execution unit 58 causes the pressing mechanism 20 to press the substrate W by the solid electrolyte membrane 12. In the pressing, the etching execution unit 58 operates the pump 22 and controls the pressure adjusting valve 23 to obtain the pressing force with which the etching is performable. Next, in this pressing state, the etching execution unit 58 causes the power supply unit 14 to invert the poles of the anode and the substrate W that serves as the cathode and apply the voltage between the anode and the substrate W in the inverted state, thus etching the surface of the substrate W. Here, since the voltage is applied while the poles are inverted, the current in the opposite direction of the current direction in the film formation flows, and consequently, the oxide formed on the surface of the substrate W can be removed. After the etching ends, the etching execution unit 58 causes the power supply unit 14 to normally switch the poles of the anode and the substrate W (return to the original state). The polarity inversion can be performed by a changeover switch that switches the connection of the positive electrode and negative electrode of the power supply unit 14.

Next, at Step S510, in the state where the re-tensioned solid electrolyte membrane 12 is in contact with the etched substrate W, the alternating current impedance is measured. While the contact state is not limited insofar as the alternating current impedance can be measured, the state of pressing the substrate W by the solid electrolyte membrane 12 may be maintained in the etching.

Specifically, the etching execution unit 58 causes the measurement execution unit 51 to execute the measurement of the alternating current impedance by the impedance measurement device 40. The measurement of the alternating current impedance is similar to the measurement of the alternating current impedance described at Step S301. The output of the alternating current impedance value by the impedance measurement device 40 and the acquisition of the alternating current impedance value by the alternating current impedance acquisition unit 52 are also similar to those at Step S301.

Next, at Step S511, the film formation redetermination unit 57 identifies the imaginary component Z"a at the predetermined frequency from the alternating current impedance values at the respective frequencies. The identification of the imaginary component Z"a at the predetermined frequency by the film formation redetermination unit 57 is similar to the identification by the film formation execution determination unit 53 at Step S302.

Next, at Step S512, it is determined whether the imaginary component Z"a at the predetermined frequency is equal to or more than the film-formable value or not. Specifically, the film formation redetermination unit 57 determines to permit the film formation of the metallic coating F when the imaginary component Z"a at the predetermined frequency is equal to or more than the film-formable value (Step S512: YES). In this case, the process returns to Step S504, and the metallic coating F is formed in the state where the etched substrate W is pressed by the re-tensioned solid electrolyte membrane 12.

On the other hand, when the imaginary component Z"a at the predetermined frequency is smaller than the film-formable value, the film formation redetermination unit 57 determines to inhibit the film formation of the metallic coating F and permit the etching of the substrate W (Step S512: NO), and the process returns to Step S509 and performs Step S509 to Step S512. Thus, the substrate W can be etched until the imaginary component Z"a at the predetermined frequency reaches the film-formable value. Finally, the process returns to Step S504 when the imaginary component Z"a becomes equal to or more than the film-formable value, and the metallic coating F is formed in the state where the etched substrate W is pressed by the re-tensioned solid electrolyte membrane 12.

While the case where the etching execution unit 58 causes the measurement execution unit 51 to execute the measurement of the alternating current impedance after the etching completion is described here, this should not be construed in a limiting sense. While the illustration is omitted, the etching execution unit 58 may cause the film formation execution unit 54 to execute the film formation of the metallic coating F after the completion of etching.

According to the film formation method for the metallic coating F of this embodiment, also when the oxide is formed on the surface of the substrate W, since the capacitance increases, the imaginary component Z" of the alternating current impedance value decreases. Therefore, by determining whether the imaginary component Z"a at the predetermined frequency is equal to or more than the film-formable value or not, it can be detected before the film formation that the oxide is formed on the surface of the substrate W. By performing the etching until the imaginary component Z"a at the predetermined frequency reaches the film-formable value, the oxide on the surface of the substrate W can be removed. It is a matter of course that, similarly to the above-described embodiment, this embodiment also provides the effect of suppression of the air entrainment.

As described above, according to the film formation method and the film formation device 1 for the metallic coating F of this embodiment, similarly to the above-described embodiment, the metallic coating can be formed while avoiding the occurrence of the spot and the burnt deposit. The occurrence of the spot and the burnt deposit can be avoided even when the film formation is continuously performed on the plurality of the substrates W.

While the case where the oxide is formed on the surface of the substrate W is described here, this should not be construed in a limiting sense. This embodiment is also applicable to a case where a contaminant that hinders the contact of the solid electrolyte membrane 12 and the substrate W and is removable by the etching is formed on the surface of the substrate.

Reference Example

Figure 7:
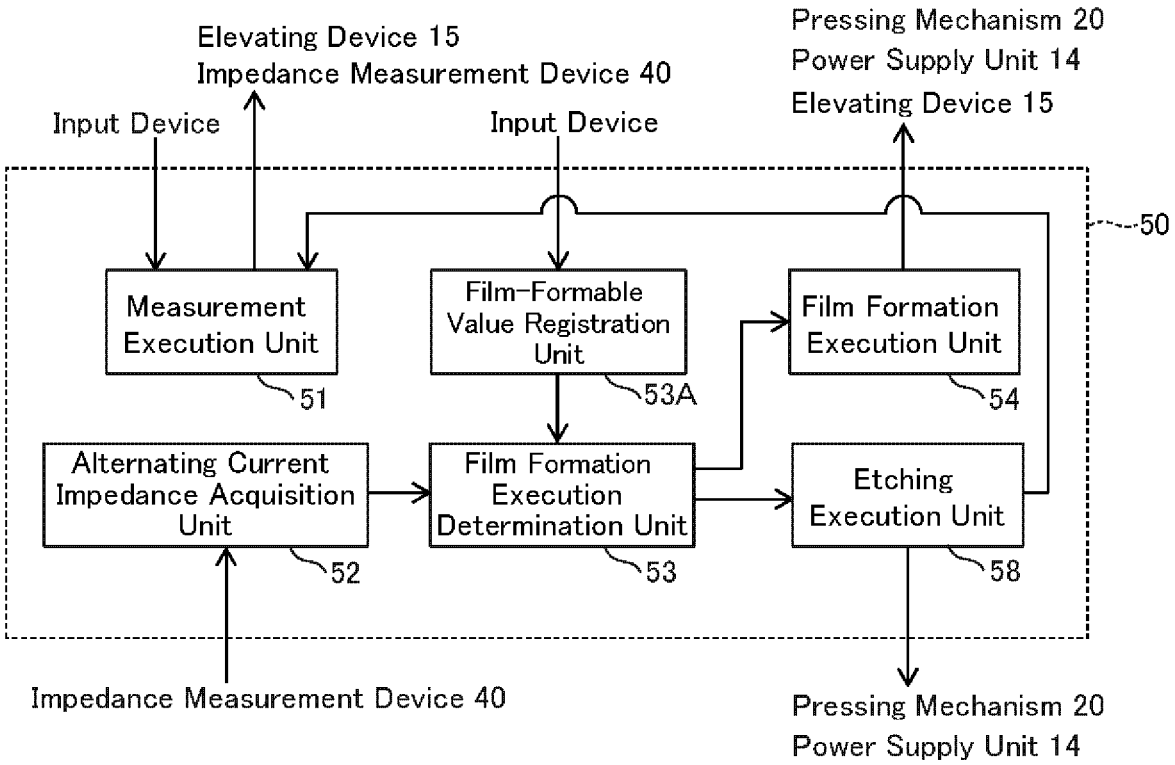
FIG. 7 is a block diagram for describing a control device according to a reference example of the film formation device illustrated in FIG. 1A.

FIG. 7 is a block diagram for describing a control device 50 according to the reference example of the film formation device 1 illustrated in FIG. 1A. The reference example is different from the first embodiments in that the etching of the substrate W is performed instead of the re-tensioning of the solid electrolyte membrane 12 when the imaginary component Z"a at the predetermined frequency is smaller than the film-formable value, and is different from the above-described second embodiment in that only the etching of the substrate W is performed. Accordingly, the following mainly describes the difference, and the same reference numerals are attached to devices and portions the same as those in the first embodiment and second embodiment, thus omitting their detailed descriptions. The control device 50 of the reference example is different from the control device 50 (see FIG. 2) of the first embodiment in that an etching execution unit 58 is included instead of the re-tensioning execution unit 55 of the first embodiment.

The film formation execution determination unit 53 of the reference example is different from the film formation execution determination unit 53 of the above-described embodiments in that inhibiting the film formation of the metallic coating F and permitting the etching of the substrate W are determined when the imaginary component Z"a at the predetermined frequency is smaller than the film-formable value. The film formation execution determination unit 53 of the reference example is different from the film formation execution determination unit 53 of the above-described embodiments in that the determination signal indicating the inhibition of the film formation is transmitted to the film formation execution unit 54 and the determination signal indicating the permission of the etching is transmitted to the etching execution unit 58.

The etching execution unit 58 of the reference example is similar to the etching execution unit 58 according to the above-described second embodiment except that the determination signal indicating the permission of the etching is transmitted from the film formation execution determination unit 53.

Figure 8:
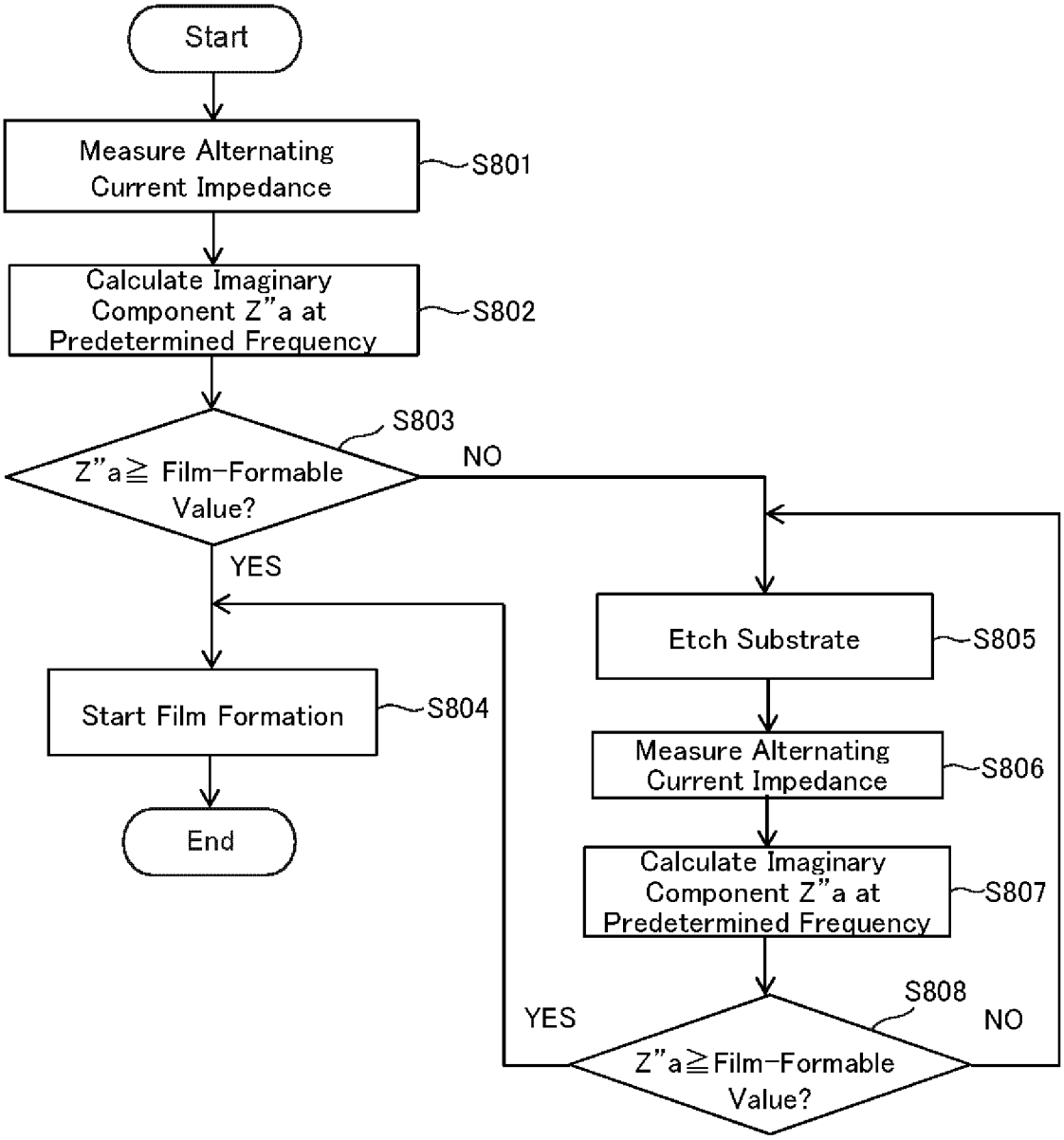
FIG. 8 is a flowchart of a film formation method for a metallic coating according to the reference example of the film formation device illustrated in FIG. 1A.

The film formation method for the metallic coating F according to the reference example will be described. FIG. 8 is a flowchart of the film formation method for the metallic coating F according to the reference example of the film formation device 1 illustrated in FIG. 1A. In the reference example, the re-tensioning mechanism 30 is not disposed in the film formation device 1.

First, Step S801 to Step S804 are the same as Step S301 to Step S304 of the above-described embodiment. Briefly describing, as illustrated in FIG. 8, at Step S801, the alternating current impedance between the anode 11 and the substrate W is measured (see FIG. 1A and FIG. 1B). Next, at Step S802, the imaginary component Z"a at the predetermined frequency is identified. Next, at Step S803, it is determined whether the imaginary component Z"a at the predetermined frequency is equal to or more than the film-formable value or not. In this determination, when the imaginary component Z"a at the predetermined frequency is equal to or more than the film-formable value (Step S803: YES), the process advances to Step S804, and the metallic coating F is formed (see FIG. 1C).

On the other hand, when the imaginary component Z"a at the predetermined frequency is smaller than the film-formable value, the film formation execution determination unit 53 determines to inhibit the film formation of the metallic coating F and permit the etching of the substrate W (Step S803: NO). In this case, the process advances to Step S805. Step S805 to Step S808 are the same as Step S509 to Step 512 according to the above-described second embodiment. However, Step S805 to Step S808 are different from Step S509 to Step 512 in that the re-tensioning of the solid electrolyte membrane 12 by the re-tensioning mechanism 30 has not been performed.

Briefly describing, as illustrated in FIG. 8, at Step S805, the surface of the substrate W is etched (see FIG. 6). Next, at Step S806, the alternating current impedance between the anode 11 and the etched substrate W is measured. Next, at Step S807, the imaginary component Z"a at the predetermined frequency is identified. Next, at Step S808, it is determined whether the imaginary component Z"a at the predetermined frequency is equal to or more than the film-formable value or not. In this determination, when the imaginary component Z"a at the predetermined frequency is equal to or more than the film-formable value (Step S808: YES), the process returns to Step S804, and the etched substrate W is pressed by the solid electrolyte membrane 12, thus forming the metallic coating F. On the other hand, when the imaginary component Z"a at the predetermined frequency is smaller than the film-formable value (Step S808: NO), the process returns to Step S805, and Step S805 to Step S808 are performed. Thus, the substrate W can be etched until the imaginary component Z"a at the predetermined frequency reaches the film-formable value. Finally, the process returns to Step S804 when the imaginary component Z"a becomes equal to or more than the film-formable value, and the etched substrate W is pressed by the solid electrolyte membrane 12, thus forming the metallic coating F.

While the case where the etching execution unit 58 causes the measurement execution unit 51 to execute the measurement of the alternating current impedance after the end of the etching is described here, this should not be construed in a limiting sense. While the illustration is omitted, the etching execution unit 58 may cause the film formation execution unit 54 to execute the film formation of the metallic coating F after the end of the etching.

According to the film formation method and the film formation device 1 for the metallic coating F of the reference example, similarly to the second embodiment, it can be detected before the film formation that the oxide is formed on the surface of the substrate W, and the oxide on the surface of the substrate W can be removed by the etching. Therefore, the metallic coating F can be formed while avoiding the occurrence of the spot and the burnt deposit, and especially, also in the continuous film formation on the plurality of the substrates W, the occurrence of the spot and the burnt deposit can be avoided.

EXAMPLES

The following describes the present disclosure based on the examples.

1. Relation Between Imaginary Component and Film Formation State

Example 1-1 to Example 1-4 and Comparative Example 1-1 to Comparative Example 1-3

Seven substrates (Cu plates) were prepared, and the metallic coating was formed using the film formation device illustrated in FIG. 1A after the measurement of the alternating current impedance as described below.

[Measurement of Alternating Current Impedance]

In the state where the solid electrolyte membrane was in contact with the substrate, the alternating current impedance between the anode and the substrate was measured while changing the voltage applied between the anode and the substrate from the high frequency to the low frequency. As a measurement device of the alternating current impedance, an impedance measurement device (HZ-7000) manufactured by HOKUTO DENKO CORPORATION was used.

The conditions of the measurement of the alternating current impedance are as follows.

Start frequency: 10 kHz
AC amplitude: 1 mA
Measurement point number/decade: 10
End frequency: 0.1 Hz
Sampling interval: 10 s

[Metallic Coating Formation]

Subsequently to the measurement of the alternating current impedance, a metallic coating formed of Cu was formed on the surface of the substrate using the film formation device illustrated in FIG. 1A. Specifically, a copper sulfate aqueous solution of 1.0 mol/L was used as the electrolyte, an oxygen free copper wire was used as the anode, Nafion (registered trademark) (thickness about 8 μm) was used as the solid electrolyte membrane, and the solid electrolyte membrane was pressed against the substrate with 0.6 MPa by the pressing mechanism, thus performing the film formation with the applied voltage of 1 V at 70° C. for a predetermined film formation period.

The film formation state of the formed copper film was evaluated. Specifically, presence/absence of the burnt deposit and the spot was evaluated. The case where the burnt deposit and the spot were present was evaluated as poor, and the case of absence was evaluated as good.

<Result and Discussion 1>

Figure 9:
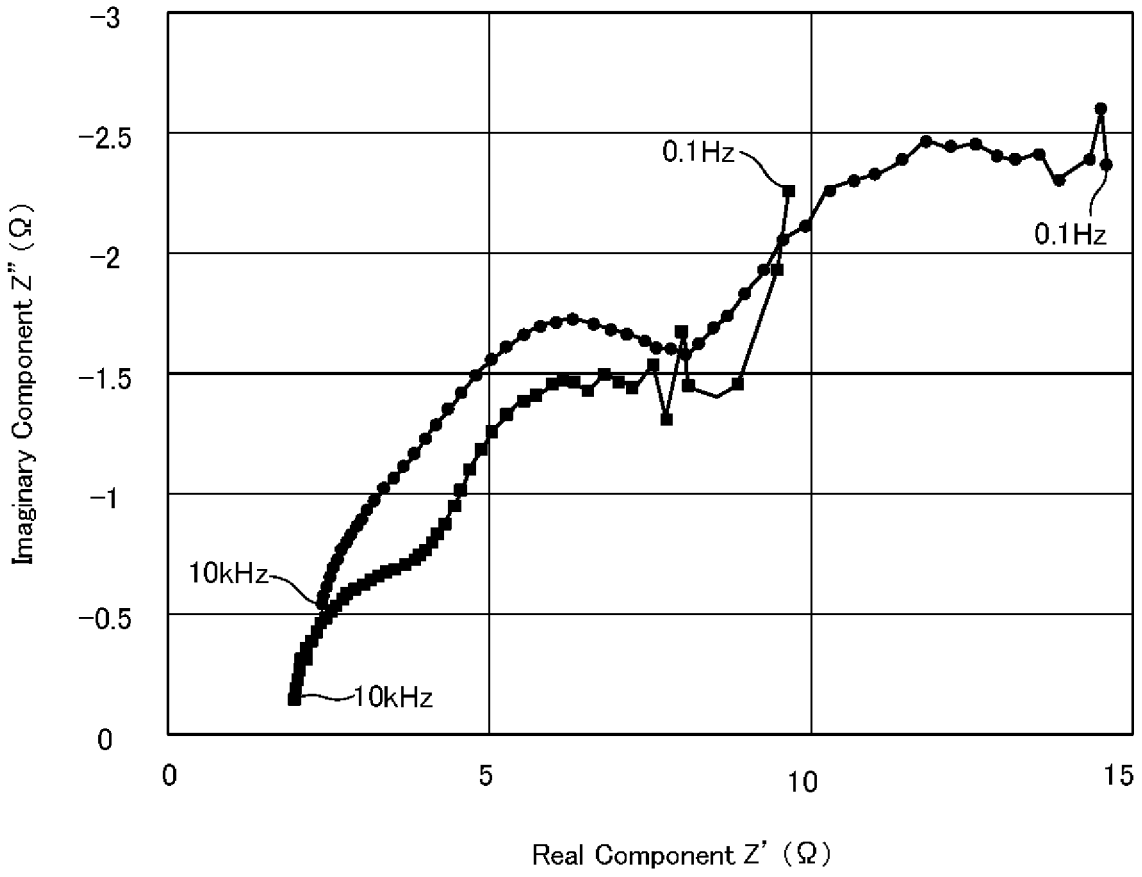
FIG. 9 is an exemplary Cole-Cole plot diagram according to an example and a comparative example.

The Cole-Cole plot diagram was created based on the measured alternating current impedance values. FIG. 9 illustrates an exemplary Cole-Cole plot diagram according to Example 1-1 to Example 1-4 in which the film formation states were good and Comparative Example 1-1 to Comparative Example 1-3 in which the film formation states were poor. Squares and circles indicate an exemplary example and an exemplary comparative example, respectively.

The Cole-Cole plot diagram illustrated in FIG. 9 has a coordinate system in which the X-axis indicates the real component Z' (Ω) of the alternating current impedance value and the Y-axis indicates the imaginary component Z" (Ω) of the alternating current impedance value. In the Cole-Cole plot diagram, the points corresponding to the respective components of the measured alternating current impedance values are plotted from the high frequency to the low frequency in the measurement order. Therefore, the frequency decreases from the left side toward the right side in the diagram.

As seen from FIG. 9, in a comparison of the imaginary components of the Y-axis at the same frequencies from the start frequency (10 kHz) to the end frequency (0.1 Hz), the imaginary component of the comparative example tended to be smaller than the imaginary component of the example. This result is discussed as follows. The cause of the occurrence of the burnt deposit and the spot includes the case where the air is entrained between the solid electrolyte membrane and the substrate and the case where the oxide is formed on the surface of the substrate that is in contact with the solid electrolyte membrane. In these cases, it is considered that the solid electrolyte membrane cannot be in contact with the substrate due to the air and the oxide, and consequently, the capacitance increases, thus decreasing the imaginary component of the Y-axis. Accordingly, it can be said that the imaginary component of the alternating current impedance value is usable as the index indicating the contact state between the solid electrolyte membrane and the substrate.

Especially, between the frequency of 10 kHz and 100 Hz, for the imaginary components of the Y-axis at the same frequencies, it was recognized that the difference between the comparative example in the poor film formation state and the example in the good film formation state increased. Accordingly, for accurately determining whether the contact state between the solid electrolyte membrane and the substrate is good or not, the imaginary component at the predetermined frequency in a range from 10 kHz to 100 Hz is employed in some embodiments. As one example, Table 1 indicates the relation between the imaginary component and the film formation state at the frequency of 10 kHz.

TABLE 1

| | Imaginary Component at 10 kHz (Ω) | Film Formation State |
|---|---|---|
| Example 1-1 | −0.070 | Good |
| Example 1-2 | −0.086 | Good |
| Example 1-3 | −0.091 | Good |
| Example 1-4 | −0.220 | Good |
| Comparative Example 1-1 | −0.550 | Poor |

TABLE 1-continued

| | Imaginary Component at 10 kHz (Ω) | Film Formation State |
|---|---|---|
| Comparative Example 1-2 | −0.600 | Poor |
| Comparative Example 1-3 | −0.640 | Poor |

As seen from Table 1, as Examples 1-1 to 1-4, the film formation state was good when the imaginary component at 10 kHz was −0.220Ω or more. On the other hand, the film formation state was poor when the imaginary component at 10 kHz was less than −0.220Ω. Accordingly, when the imaginary component at the frequency of 10 kHz is used as the index indicating the contact state between the solid electrolyte membrane and the substrate, the film-formable value at which the film formation becomes performable is preliminarily set to −0.220Ω. Thus setting the film-formable value allows forming the metallic coating while avoiding the occurrence of the spot and the burnt deposit in the film formation when the imaginary component at the frequency of 10 kHz is −0.220Ω or more.

On the other hand, it can be said that, when the imaginary component is less than −0.220Ω, performing the treatment for improving the contact state between the solid electrolyte membrane and the substrate until the imaginary component becomes −0.220Ω or more allows forming the metallic coating while avoiding the occurrence of the spot and the burnt deposit.

2. Relation Between Etching and Imaginary Component

The substrate having the substrate surface in a poor state where, for example, an oxide was formed on the surface of the substrate in contact with the solid electrolyte membrane was prepared, thus performing the etching of the prepared substrate using the film formation device illustrated in FIG. 1A. The prepared substrate is a substrate in which the imaginary component at 10 kHz is less than −0.220Ω in the above-described measurement (first time) of the alternating current impedance, and the imaginary component at 10 kHz is less than −0.220Ω in the second measurement of the alternating current impedance performed again (second time) after the re-tensioning of the solid electrolyte membrane.

Example 2-1

Using the substrate in which the imaginary component at 10 kHz was −0.55Ω in the second measurement of the alternating current impedance, the re-tensioned solid electrolyte membrane was pressed against the substrate by the pressing mechanism with the pressing force of 0.2 MPa, thus inverting the poles of an electrode that served as the anode and the substrate that served as the cathode. Next, a voltage was applied between the anode and the substrate, and the surface of the substrate was etched under the condition of the current of 10 mA for 10 seconds (first time). This etching was continuously performed further twice, thus performing the etching three times in total. Every time at the end of the etching, the above-described measurement of the alternating current impedance was performed. The measurement of the alternating current impedance was performed in the state of keeping the pressing force in the etching.

Example 2-2

The etching was performed similarly to Example 2-1 except that the imaginary component at 10 kHz of the used substrate was −0.60Ω, thus measuring the alternating current impedance.

Example 2-3

The etching was performed similarly to Example 2-1, thus measuring the alternating current impedance. However, Example 2-3 is different from Example 2-1 in that the imaginary component at 10 kHz of the used substrate was −0.64Ω, and the pressing force in the etching was 0.6 MPa.

Example 2-4

The etching was performed similarly to Example 2-3 except that the imaginary component at 10 kHz of the used substrate was −0.61Ω, thus measuring the alternating current impedance.

Comparative Example 2-1

The etching was performed similarly to Example 2-1, thus measuring the alternating current impedance. However, Comparative Example 2-1 is different from Example 2-1 in that the imaginary component at 10 kHz of the used substrate was −0.71Ω, and the pressing force by the pressing mechanism was released (that is, the pressing force was 0.0 MPa) in the etching.

Comparative Example 2-2

The etching was performed similarly to Comparative Example 2-2 except that the imaginary component at 10 kHz of the used substrate was −0.58Ω, thus measuring the alternating current impedance.

The imaginary components at the frequency of 10 kHz were identified from the measured alternating current impedances. Table 2 illustrates the result.

TABLE 2

| | Pressing | Imaginary Component at 10 kHz (Ω) | | | |
|---|---|---|---|---|---|
| | Force [MPa] | Before Etching | First Etching | Second Etching | Third Etching |
| Example 2-1 | 0.2 | −0.55 | −0.20 | −0.10 | −0.08 |
| Example 2-2 | 0.2 | −0.60 | −0.50 | −0.40 | −0.38 |
| Example 2-3 | 0.6 | −0.64 | −0.10 | −0.09 | −0.05 |
| Example 2-4 | 0.6 | −0.61 | −0.08 | −0.08 | −0.05 |
| Comparative Example 2-1 | 0.0 | −0.71 | −0.70 | −0.68 | −0.68 |
| Comparative Example 2-2 | 0.0 | −0.58 | −0.57 | −0.57 | −0.56 |

<Result and Discussion 2>

As Comparative Examples 2-1, 2-2, when the pressing force is not applied (0.0 MPa), almost no change in the imaginary component at 10 kHz was observed even when the etching was repeated. On the other hand, as Examples 2-1 to 2-4, performing the etching while applying the pressing force increased the imaginary component at 10 kHz after the etching compared with that before the etching.

This result is considered to indicate that, when the surface of the substrate in contact with the solid electrolyte membrane was in the poor state, the oxide and the like on the surface of the substrate were removed by performing the etching while pressing the substrate by the solid electrolyte membrane under the condition of the predetermined pressing force.

Accordingly, when the film formation of the metallic coating is performed in the state where the etching is performed until the imaginary component at the predetermined frequency reaches the film-formable value and the etched substrate is pressed by the solid electrolyte membrane, the metallic coating can be formed while avoiding the occurrence of the spot and the burnt deposit.

While the one embodiment of the present disclosure has been described in detail above, the present disclosure is not limited thereto, and can be subjected to various kinds of changes in design without departing from the spirit or scope of the present disclosure described in the claims.

DESCRIPTION OF SYMBOLS

1 Film formation device
11 Anode
12 Solid electrolyte membrane
13 Housing
14 Power supply unit
15 Elevating device
20 Pressing mechanism
30 Re-tensioning mechanism
40 Impedance measurement device
50 Control device
51 Measurement execution unit
53 Film formation execution determination unit
54 Film formation execution unit
55 Re-tensioning execution unit
56 Remeasurement execution unit
57 Film formation redetermination unit
58 Etching execution unit
S Electrolyte containing metal (metal solution)
W Substrate
F Metallic coating

What is claimed is:

1. A film formation method for a metallic coating, wherein the metallic coating is derived from metal ions and is formed on a surface of a substrate by disposing a solid electrolyte membrane between an anode and the substrate that serves as a cathode, pressing the substrate by the solid electrolyte membrane with a fluid pressure of an electrolyte that is disposed between the anode and the solid electrolyte membrane and contains the metal ions, and applying a voltage between the anode and the substrate in a state of pressing the substrate, the method comprises:

measuring an alternating current impedance between the anode and the substrate in a state where the solid electrolyte membrane is in contact with the substrate;

determining whether an imaginary component at a predetermined frequency of the alternating current impedance is equal to or more than a preliminarily set film-formable value or not, the imaginary component at the predetermined frequency indicating a contact state between the solid electrolyte membrane and the substrate, and a film formation becoming performable at the film-formable value;

when the imaginary component is equal to or more than the film-formable value in the determining, forming the metallic coating in a state where the substrate is pressed by the solid electrolyte membrane; and when the imaginary component is smaller than the film-formable value in the determining, forming the metallic coating in a state where the pressing of the substrate by the solid electrolyte membrane is released to separate the solid electrolyte membrane from the substrate, the solid electrolyte membrane is re-tensioned with a constant tensile force, and subsequently, the substrate is pressed by the re-tensioned solid electrolyte membrane.

2. The film formation method for the metallic coating according to claim 1, further comprising:

remeasuring the alternating current impedance after the re-tensioning of the solid electrolyte membrane, and redetermining whether the imaginary component of the remeasured alternating current impedance is equal to or more than the film-formable value or not;

when the imaginary component is equal to or more than the film-formable value in the redetermining, forming the metallic coating in a state where the substrate is pressed by the re-tensioned solid electrolyte membrane; and when the imaginary component is smaller than the film-formable value in the redetermining, forming the metallic coating in a state where poles of the anode and the substrate that serves as the cathode are inverted in the state where the substrate is pressed by the re-tensioned solid electrolyte membrane, subsequently, the surface of the substrate is etched by applying a voltage between the anode and the substrate until the imaginary component reaches the film-formable value, and the etched substrate is pressed by the re-tensioned solid electrolyte membrane.

3. A film formation device for a metallic coating, comprising:

an anode;

a solid electrolyte membrane disposed between the anode and a substrate that serves as a cathode;

a housing that houses an electrolyte containing metal ions, the solid electrolyte membrane being mounted to the housing, the electrolyte being disposed between the anode and the solid electrolyte membrane;

an elevating device that moves up and down the housing in an interval from a position at which the solid electrolyte membrane is separated from the substrate to a position at which the solid electrolyte membrane contacts the substrate;

a pressing mechanism that pressurizes the electrolyte housed in the housing to press the substrate in contact with the solid electrolyte membrane by the solid electrolyte membrane; and a power supply unit that applies a voltage between the anode and the substrate, wherein a metallic coating derived from the metal ions is formed on a surface of the substrate by applying the voltage between the anode and the substrate in a state where the substrate is pressed, wherein the film formation device further includes:

an impedance measurement device that measures an alternating current impedance between the anode and the substrate in a state where the solid electrolyte membrane is in contact with the substrate;

a re-tensioning mechanism that re-tensions the solid electrolyte membrane mounted to the housing with a constant tensile force; and a control device that controls at least the moving up and down by the elevating device, the pressing by the pressing mechanism, the applying the voltage by the power supply unit, executing the measurement by the impedance measurement device, and the re-tensioning by the re-tensioning mechanism, wherein the control device includes:

a measurement execution unit that causes the impedance measurement device to execute the measurement of the alternating current impedance in a state where the housing is moved down by the elevating device to the position at which the solid electrolyte membrane contacts the substrate to bring the solid electrolyte membrane into contact with the substrate;

a film formation execution determination unit that determines to permit the film formation of the metallic coating when an imaginary component at a predetermined frequency of the alternating current impedance measured by the measurement execution unit is equal to or more than a preliminarily set film-formable value at which the film formation becomes performable, and determines to inhibit the film formation of the metallic coating when the imaginary component is smaller than the film-formable value, the imaginary component at the predetermined frequency indicating a contact state between the solid electrolyte membrane and the substrate;

a film formation execution unit that forms the metallic coating by causing the pressing mechanism to press the substrate by the solid electrolyte membrane and causing the power supply unit to apply the voltage when the film formation execution determination unit has determined to permit the film formation; and a re-tensioning execution unit that causes the pressing mechanism to release the pressing of the substrate by the solid electrolyte membrane, causes the elevating device to move up the housing to the position at which the solid electrolyte membrane is separated from the substrate, and causes the re-tensioning mechanism to re-tension the solid electrolyte membrane with the constant tensile force when the film formation execution determination unit has determined to inhibit the film formation.

4. The film formation device for the metallic coating according to claim 3, wherein the control device further includes:

a remeasurement execution unit that causes the measurement execution unit to execute a remeasurement of the alternating current impedance by the impedance measurement device after the re-tensioning of the solid electrolyte membrane by the re-tensioning execution unit;

a film formation redetermination unit that determines to permit the film formation of the metallic coating when the imaginary component of the alternating current impedance remeasured by the remeasurement execution unit is equal to or more than the preliminarily set film-formable value at which the film formation becomes performable, and determines to inhibit the film formation of the metallic coating and permit an etching of the substrate when the imaginary component is smaller than the film-formable value; and an etching execution unit that etches the surface of the substrate by causing the pressing mechanism to press the substrate by the solid electrolyte membrane, and causing the power supply unit to invert poles of the anode and the substrate that serves as the cathode and apply a voltage until the imaginary component reaches the film-formable value when the film formation redetermination unit has determined to permit the etching, wherein the film formation execution unit forms the metallic coating by causing the pressing mechanism to press the substrate by the solid electrolyte membrane and causing the power supply unit to apply the voltage when the film formation redetermination unit has determined to permit the film formation and when the etching execution unit has completed the etching.

* * * * *